US009179728B2

(12) United States Patent
Pfanner et al.

(10) Patent No.: US 9,179,728 B2
(45) Date of Patent: Nov. 10, 2015

(54) PROTECTIVE HELMET, IN PARTICULAR FOR FORESTRY WORKERS

(75) Inventors: Anton Pfanner, Hohenems (AT); Martin Greber, Götzis (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 292 days.

(21) Appl. No.: 13/808,664

(22) PCT Filed: Jul. 12, 2011

(86) PCT No.: PCT/EP2011/061879

§ 371 (c)(1),
(2), (4) Date: Feb. 25, 2013

(87) PCT Pub. No.: WO2012/007472

PCT Pub. Date: Jan. 19, 2012

(65) Prior Publication Data

US 2013/0205477 A1 Aug. 15, 2013

(30) Foreign Application Priority Data

Jul. 13, 2010 (DE) ..... 10 2010 027 012

(51) Int. Cl.
*A42B 3/14* (2006.01)
*A42B 3/16* (2006.01)

(52) U.S. Cl.
CPC .. *A42B 3/14* (2013.01); *A42B 3/166* (2013.01)

(58) Field of Classification Search
CPC ..... A42B 3/14; A42B 3/166; A42B 3/30
USPC ..... 2/416, 410, 417
See application file for complete search history.

(56) References Cited

U.S. PATENT DOCUMENTS 3,025,525 A * 3/1962 Larson ..... 2/419
3,156,923 A * 11/1964 Timm ..... 2/419

(Continued)

FOREIGN PATENT DOCUMENTS

| | | | |
|---|---|---|---|
| DE | 2061087 | A | 12/1970 |
| DE | 7510978 | U | 7/1975 |
| DE | 2907056 | A1 | 8/1980 |
| DE | 3314595 | A1 | 11/1983 |
| DE | 2826636 | C2 | 5/1987 |
| DE | 8714490 | U1 | 9/1988 |
| DE | 3314595 | C2 | 11/1991 |
| DE | 9410596 | U1 | 8/1994 |
| DE | 3590667 | C2 | 9/1996 |
| DE | 29708134 | U1 | 8/1997 |
| DE | 69811738 | T2 | 8/2003 |
| DE | 102004004044 | B4 | 6/2007 |
| DE | 102006013025 | A1 | 10/2007 |
| DE | 102007053190 | A1 | 5/2009 |
| JP | 2007-297743 | A | 11/2007 |
| WO | 97/19606 | A1 | 6/1997 |
| WO | 2005/027671 | A1 | 3/2005 |

(Continued)

OTHER PUBLICATIONS

International Search Report dated Oct. 5, 2011, issued in International Application PCT/EP2011/061879.

*Primary Examiner* — Anna Kinsaul
(74) *Attorney, Agent, or Firm* — Fitch, Even, Tabin & Flannery, LLP

(57) ABSTRACT

A protective helmet has a helmet shell and with an interior fitting subassembly having at least one supporting cage, a head band and a neck band. Three supporting arms can serve to fasten the subassembly to the helmet shell with a spacing. A clearance can thus be provided between the interior fitting subassembly and the helmet shell for receiving ear protection capsules and supporting brackets of an ear protection and of other helmet accessories. When not in use, the ear protection can be pivoted under the helmet shell. The protective helmet therefore does not provide any engagement possibilities for obstacles such as branches and the like. The supporting arms can partially transmit a force acting on the helmet from above back into the helmet shell in order to elastically deform the latter. The helmet therefore has an improved shock absorption capability.

16 Claims, 20 Drawing Sheets

(56) References Cited

U.S. PATENT DOCUMENTS

Figure 1:
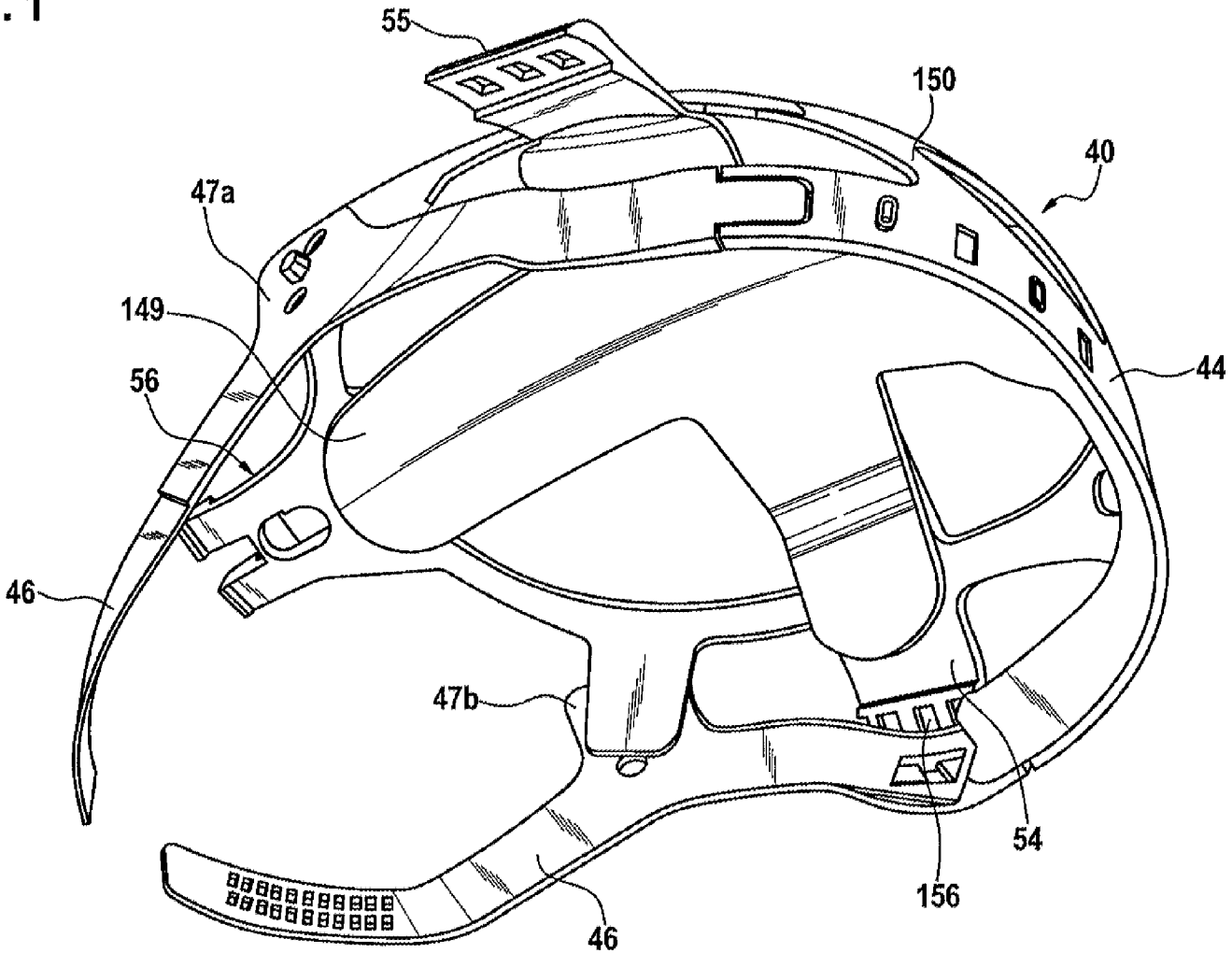

| | | | | | |
|---|---|---|---|---|---|
| 3,383,705 | A * | 5/1968 | Raschke | 2/416 |
| 3,852,821 | A * | 12/1974 | Mickel | 2/415 |
| 4,069,512 | A | 1/1978 | Palmaer | |
| 5,105,475 | A * | 4/1992 | Lynd et al. | 2/10 |
| 6,081,931 | A * | 7/2000 | Burns et al. | 2/411 |
| 6,298,249 | B1 * | 10/2001 | Locarno et al. | 455/575.2 |
| 8,850,624 | B2 * | 10/2014 | Gleason et al. | 2/417 |
| 2007/0261153 | A1 | 11/2007 | Wise et al. | |
| 2012/0144567 | A1 * | 6/2012 | Huh | 2/424 |

* cited by examiner

PROTECTIVE HELMET, IN PARTICULAR FOR FORESTRY WORKERS

CROSS-REFERENCE TO RELATED APPLICATIONS

This application is a U.S. National Stage filing under 35 U.S.C. 371 of International Application No. PCT/EP2011/061879, filed Jul. 12, 2011, designating the United States and claims the benefit of foreign priority from German Patent Application Number 10 2010 027012.1, filed Jul. 13, 2010, the entire disclosures of which are incorporated herein by reference.

The invention relates to a protective helmet, particularly for forestry workers, comprising a helmet shell, interior fittings comprising a subassembly contacting the head of at least one supporting cage, one head band and one neck band, and means for fixing this subassembly to the helmet shell.

A protective helmet of this type is known from the document DE 8714490 U1. This known protective helmet is a basic helmet adjustable to the different purposes under different service conditions by exchanging accessory elements. The protective helmet consists of a helmet shell and minimum interior fittings. The interior fittings are comprised of a crossed strap by means of which the helmet is worn on the head and which ensures a shock-absorbing clearance between the head and the helmet shell. The helmet is, at its outer circumference, provided with a protrusion spanning the lateral and the rear part of the helmet and having four recesses for fixing the crossed strap at the lower edge and further recesses for fixing additional accessory elements. The basic version of the helmet may be used as a simple universal helmet without any accessories. The accessories may be added or removed as required. At the broadest sections of the helmet, a recess is provided at the outside of the protrusion spanning the largest part of the helmet. This is the mounting position for a face and ear protection. This protection consists of a visor and two ear protectors which respectively comprise a wire bracket and an ear protection capsule. The face and the ear protection are fixed to the helmet from the outside by means of a common connecting element which is inserted into the protrusion. A disadvantage of a helmet killed out like this is that, in service, obstacles the helmet passes may get caught behind the brackets of the ear protection and/or the visor and thus become an encumbrance to the wearer of the helmet in the field or rip the helmet off his head and thereby imperil the wearer.

Other documents describing the mounting of helmet accessories such as a face and/or ear protection on the outside of a protective helmet are the DE 28 26 636 C2, DE 29 07 056 A1, DE 33 14 595 C2, DE 35 90 667 C2, DE 97 10 596 U1 and DE 297 08 134 U1. With the protective helmets known from these documents the wearer of the helmet may also be hampered or endangered on duty if obstacles get caught on the brackets of the ear and/or face protection.

Further documents concerned with the mutual fixation of interior fitting subassembly and helmet shell, not, however, with mounting helmet accessories on the outside of the helmet shell, are listed below.

From the document DE 102004004044 B4, a protective helmet is known in which the interior fittings comprising a subassembly contacting the head and comprised of a supporting cage, a head band and a neck band are provided with connecting elements which are inserted into a shield which, in turn, is fixed on the lower edge of the helmet shell.

From the document DE 69811738 T2, a protective helmet is known in which the interior fittings comprising a subassembly contacting the head and comprised of a supporting cage, a head band and a neck band are fixed with the aid of anchoring links which are inserted into slots at four positions in the lower edge of a double-walled helmet shell. The head band is made of a flexible material which can be easily adjusted to the size and shape of the head of the wearer.

From the document WO 2005/027671 A1, a safety helmet is known in which a shock absorption unit surrounding the remaining interior fittings and comprising a subassembly contacting the head and comprised of a supporting cage, a head band and a neck band is disposed in the helmet shell. On the inner side of the helmet shell protrusions are provided on which the shock absorption unit and the interior fitting subassembly can be fixed by means of screws. In this known safety helmet the shock absorption unit is formed so thick that it is possible to provide a recess in which a transmitter/receiver having a connection line leading to the outside may be accommodated in its outer side facing the inner side of the helmet.

It is common to all the known protective helmets mentioned above that a force acting on the helmet from the outside is substantially fully transmitted to the head of the wearer of the helmet via the interior fittings and particularly via a supporting cage formed by a crossed strap. Namely, the crossed strap can only fulfil a shock absorption function to a certain degree because it has the additional function to tightly hold the helmet on the head of the wearer. There is therefore also a demand for a protective helmet having an improved shock absorption capability.

It is the object of the invention to provide a protective helmet of the type mentioned in the beginning and known from the first mentioned document so that, together with an improved shock absorption capability, the risk that the helmet may get caught in obstacles in use due to helmet accessories such as a face and/or ear protection mounted to it is eliminated, and that the protective helmet is, in particular, suitable for the use in forestry.

According to the invention, this object is solved by the fixation means comprising at least three supporting arms formed as spacers and by the helmet shell being dimensioned so and by the supporting arms being dimensioned and arranged so that a clearance for accommodating ear protection capsules along with supporting brackets and other helmet accessories as well as mounting devices for at least one face and ear protection exists between the interior fitting subassembly and the helmet shell.

In the protective helmet according to the invention, the mounting devices for at least one face and one ear protection are located inside of the helmet shell so that the supporting brackets and support arms of the face and ear protection are disposed within the perimeter of the protective helmet so that it offers no possibilities for an engagement of obstacles such as branches and the like on its outside. If the ear protection is not needed it may, furthermore, be pivoted backwards inside the perimeter of the protective helmet so that the helmet offers even less engagement positions for obstacles. Since the mounting devices for the face protection are also disposed in the clearance the visor can be designed so that it offers engagement possibilities for obstacles such branches or the like neither in the tilted-up nor in the tilted-down state. The supporting arms arranged as spacers between the interior fitting subassembly and the helmet shell offer the possibility to absorb a force acting on the helmet from the outside only by a deformation of the helmet shell so that the protective helmet according to the invention has an altogether better shock absorption capability because less force is transmitted to the head of the wearer.

The subject matter of the sub-claims is advantageous embodiments of the protective helmet according to the invention.

In one embodiment of the protective helmet according to the invention, the supporting cage is formed of a stiff, elastically flexible material, and the supporting arms are rigid and formed on the supporting cage in two temple areas and in an area of the back of the head and protrude obliquely downwards or backwards from the supporting cage and are fixed to the helmet shell at their free ends, respectively. In the protective helmet according to the invention the support and shock absorption functions are combined in the supporting cage made of a stiff, elastically flexible material in this embodiment. In fulfilling the shock absorption function the supporting cage is supported by the helmet shell since the arms protruding obliquely downwards or backwards support the supporting cage on the helmet shell with their free ends so that in case of an external pressure acting on the helmet shell from above a tensile load is applied to the supporting arms by the helmet shell whereby the supporting arms are striving to deform the helmet shell towards the inside.

In a further embodiment of the protective helmet according to the invention, the mounting device for the ear protection comprises two ear protection supporting points on the inside of the helmet shell in which supporting brackets comprising ear protection capsules are pivotably supported. In addition to the supporting brackets and the ear protection capsules, the ear protection supporting points are also protected against the effects of an external force exerted by obstacles the helmet may get in contact with in this embodiment.

In a further embodiment of the protective helmet according to the invention, the ear protection supporting points and the supporting brackets are arranged and formed so that the supporting brackets are respectively pivotable between two positions within the clearance, an operating position in which the ear protection capsules cover the ears and are still located within the perimeter of the helmet shell, and a parking position in which the ear protection capsules including the supporting brackets are accommodated in the clearance. In this embodiment the supporting brackets and the ear protection capsules do not offer any engagement or catching points for obstacles in both positions.

In a further embodiment of the protective helmet according to the invention, the mounting device for the face protection comprises two face protection supporting points on the inside of the helmet shell in which two support arms of a visor are pivotably supported. In this embodiment the support arms and their connection to the visor can be formed in a simple manner so that the visor offers no engagement or catching possibilities for obstacles such as branches or the like.

In a further embodiment of the protective helmet according to the invention, the face protection supporting points and the support arms are arranged and formed so that the support arms are respectively pivotable between two positions within the clearance, an operating position, in which the visor protects the face, and a parking position in which the visor is located on the outer surface of the helmet shell in a tightly abutting manner. The support arms may, in this embodiment, be, from the beginning, be mounted on the visor so that they remain within the perimeter of the helmet shell and offer no engagement or catching points for obstacles such as branches or the like.

In a further embodiment of the protective helmet according to the invention, the supporting cage comprises, at its lower edge, a peripherally closed support strip on which the supporting arms are integrally formed. In this embodiment the supporting arms and the support strip form an integral component having the required stiffness and yet offering a sufficient shock absorption effect together with the remaining part of the supporting cage.

In a further embodiment of the protective helmet according to the invention, the neck band is attached to the supporting cage and has two ends releasably connected in the neck area by a tightening unit accommodated in the clearance as a further helmet accessory. The neck band is thus also protected against the external effect of obstacles and still accessible for the operation by the wearer of the helmet.

In a further embodiment of the protective helmet according to the invention, the tightening unit comprises a supporting shell which can be tightened against the back of the head of the wearer of the helmet when tightening the neck band with the aid of a latch flap. This embodiment ensures a reliable one-hand operation and, above that, permits the fixation of the interior fitting subassembly on the head in a simple manner. The use of a common chin strap will then offer additional safety.

In a further embodiment of the protective helmet according to the invention the supporting arms protruding downwards in the two temple areas comprise means for a releasable fixation on the inside of the helmet shell. The interior fitting subassembly can therefore be readily and releasably attached to the helmet shell.

In a further embodiment of the protective helmet according to the invention, the fixation means on each of the supporting arms protruding downwards are formed so that they can be brought in a positive engagement with the helmet shell. In this way a force can be transferred via the mounting position for the interior fitting subassembly on the inside of the helmet shell in a simple manner.

In a further embodiment of the protective helmet according to the invention, the supporting arm protruding backwards in the area of the back of the head comprises a locking device for a fixation to the helmet shell. In this embodiment the helmet shell may simply have an aperture into which the free end of the above supporting arm is inserted so as to be latched to the helmet shell so as to be capable of transferring a force via the mounting position.

In a further embodiment of the protective helmet according to the invention, the face protection supporting points are formed as connectors fit to the rod-like protrusions above the supporting arms. The face protection may, in this way, be readily mounted and, at the same time, serves to keep the free ends of the arms fixed to the rod-like protrusions of the helmet shell.

In a further embodiment of the protective helmet according to the invention, the through-holes respectively encompass the rod-like protrusions on a length at least equal to the inner width of the through-holes so that a force exerted to the supporting arms from above due to a load acting on the helmet generates a momentum at the supporting arms which strives to deform the helmet shell towards the inside as far as to the lower edge. In this embodiment thus the shock absorption function of the interior fitting subassembly can be supported in a simple manner by the elastic deformation of the helmet shell. The through-holes at the free ends of the supporting arms protrusions are adjusted depending on the rod-like so that a leverage effect can be exerted to the rod-like protrusions when a force acts on the helmet shell.

In a further embodiment of the protective helmet according to the invention, the supporting cage comprises two support arms protruding downwards to which the neck band is respectively fixed in a selectable height. In this way the fit of the protective helmet can be improved in a simple manner.

In a further embodiment of the protective helmet according to the invention, the supporting arms and the support arms are further stiffened by integrally formed ribs. In this way, the force transmission via the mounting position can be ensured in a simple manner.

Figure 2:
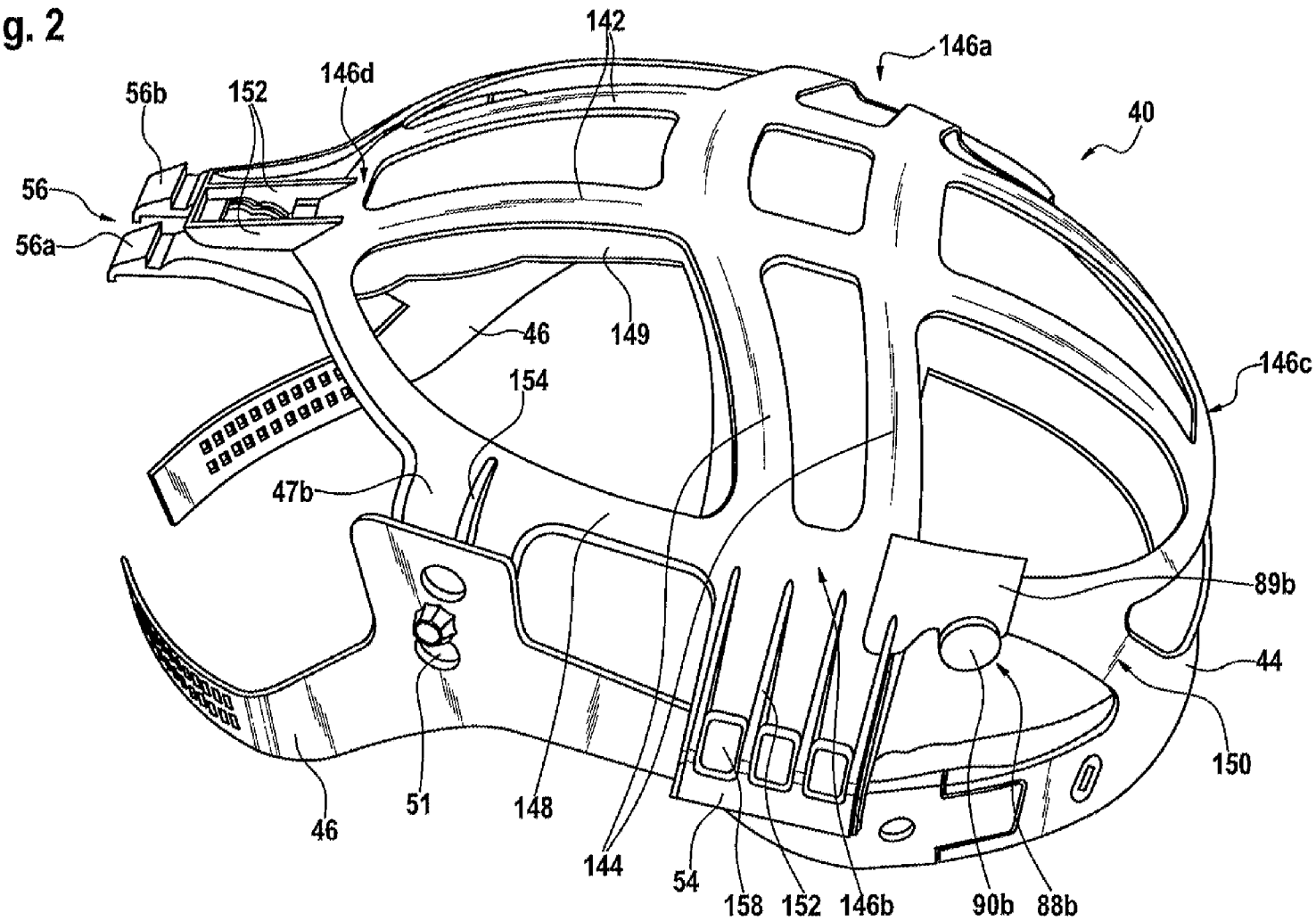
Figure 3:
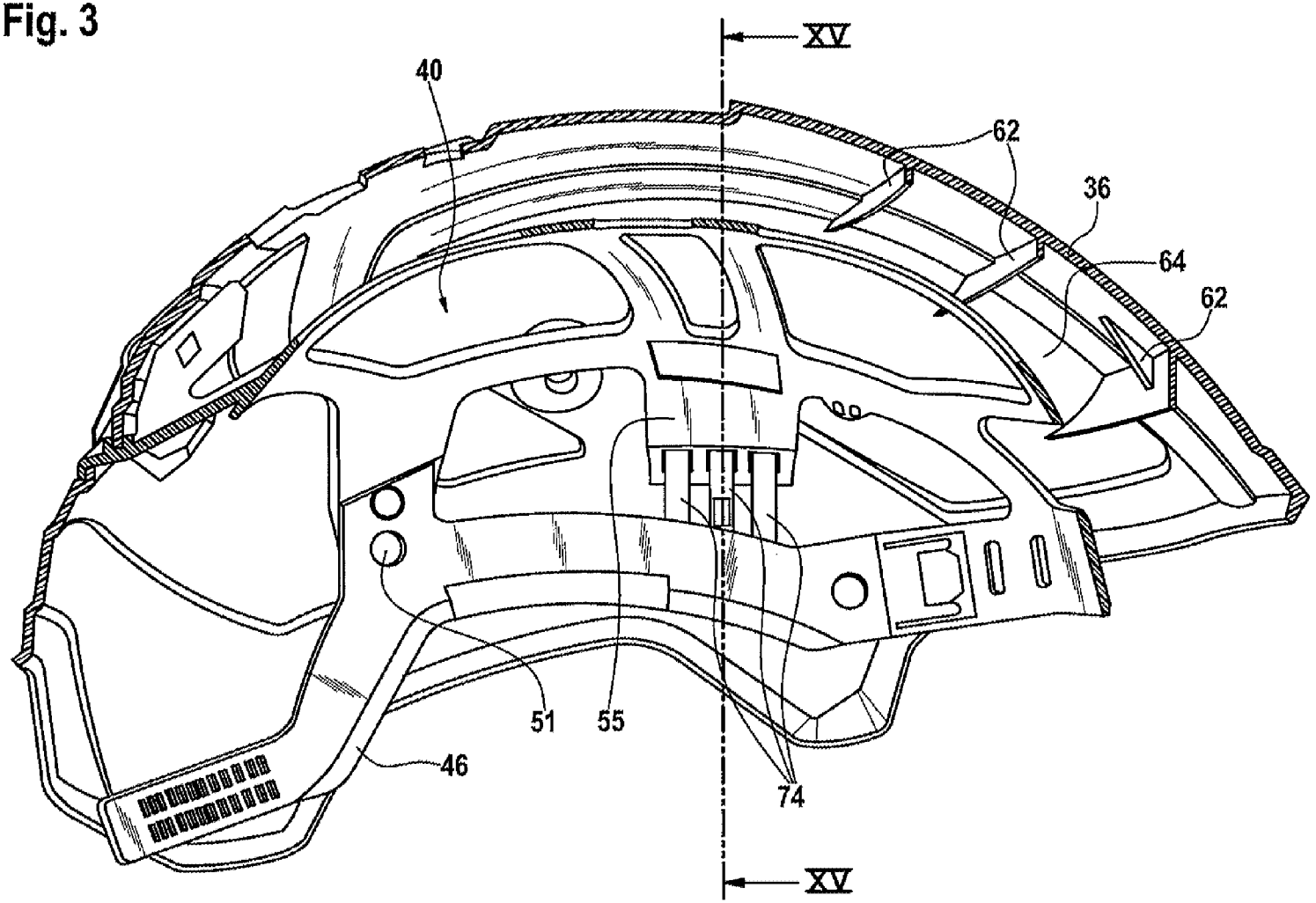
Figure 4:
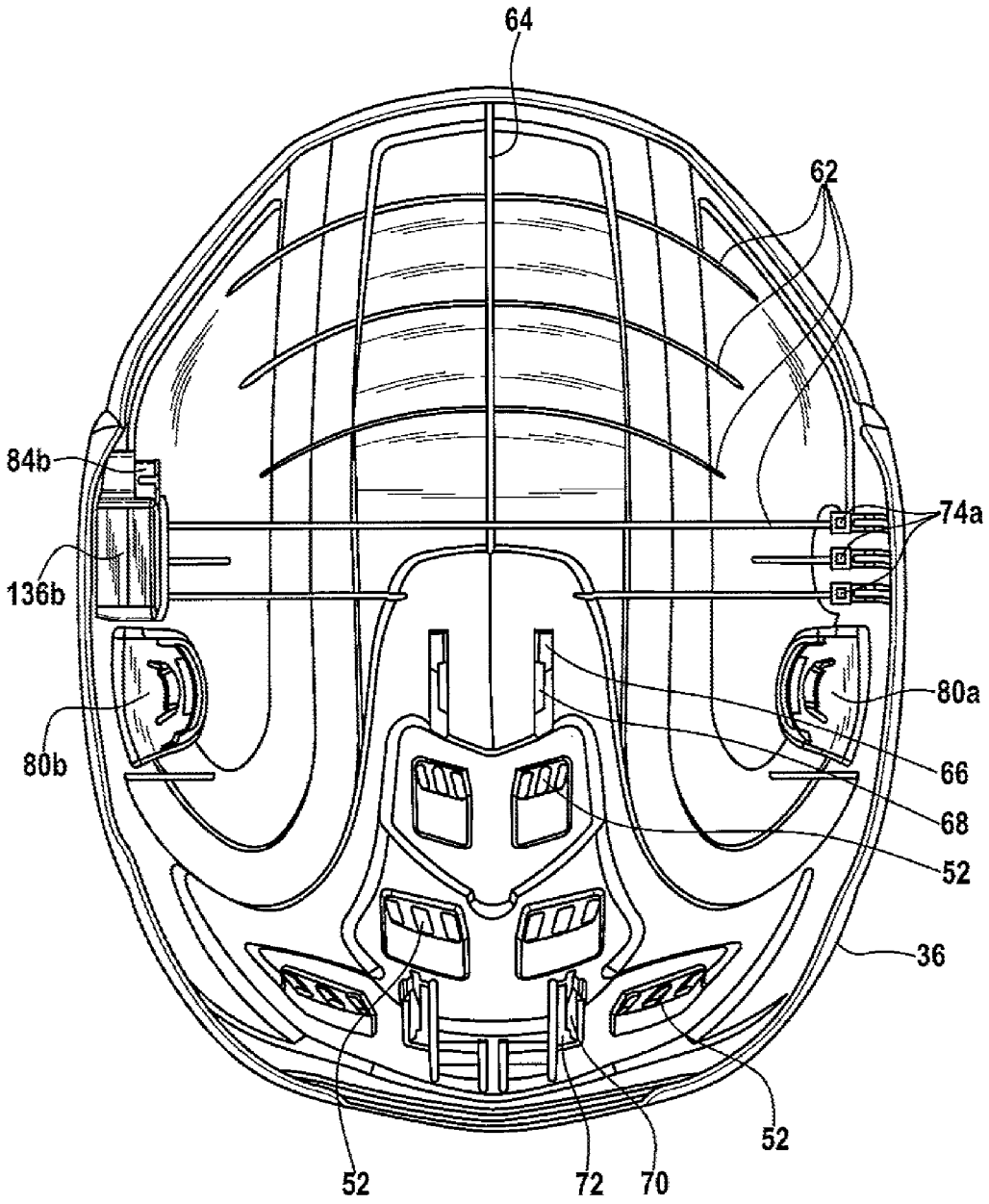
Figure 5:
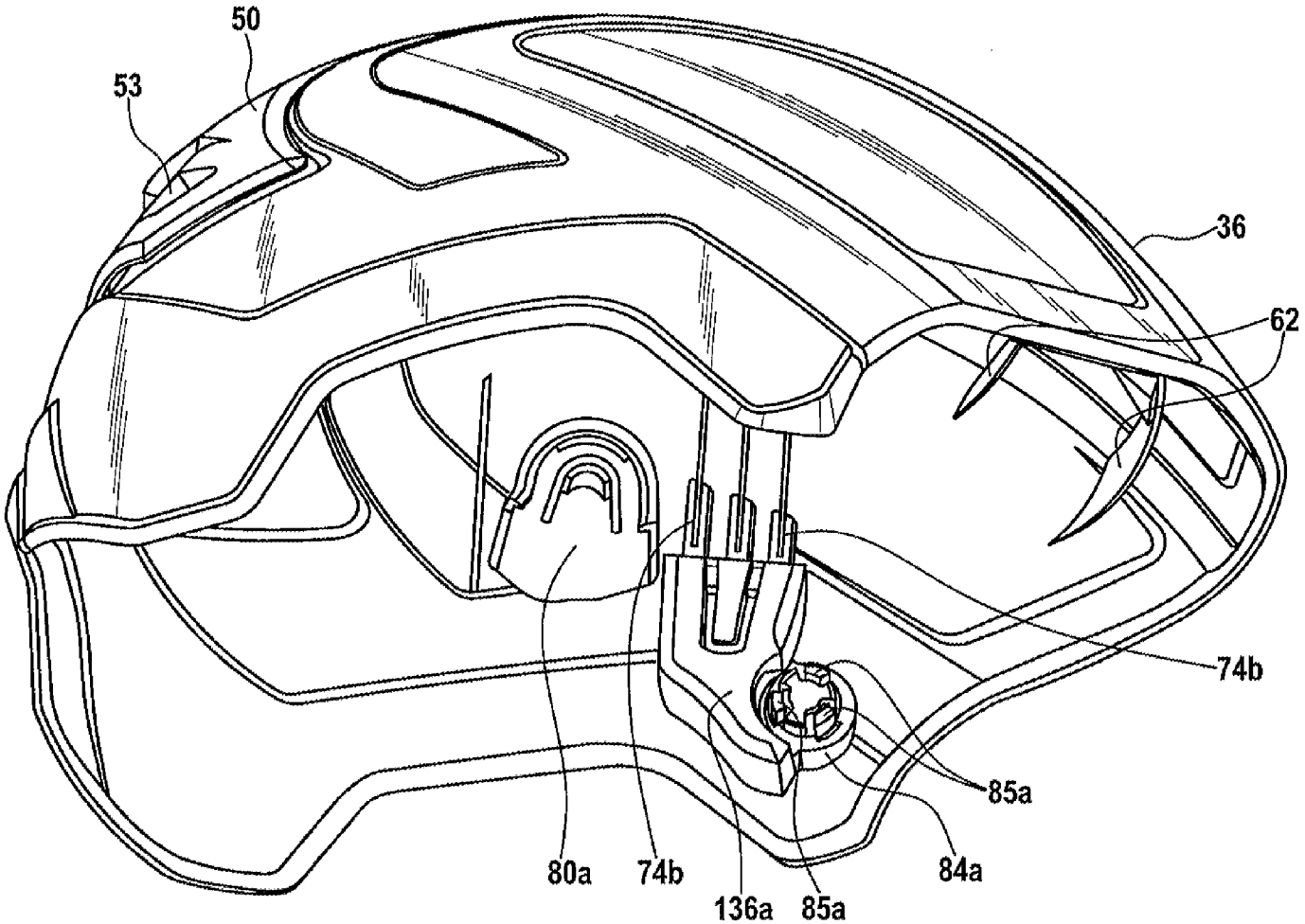
Figure 6:
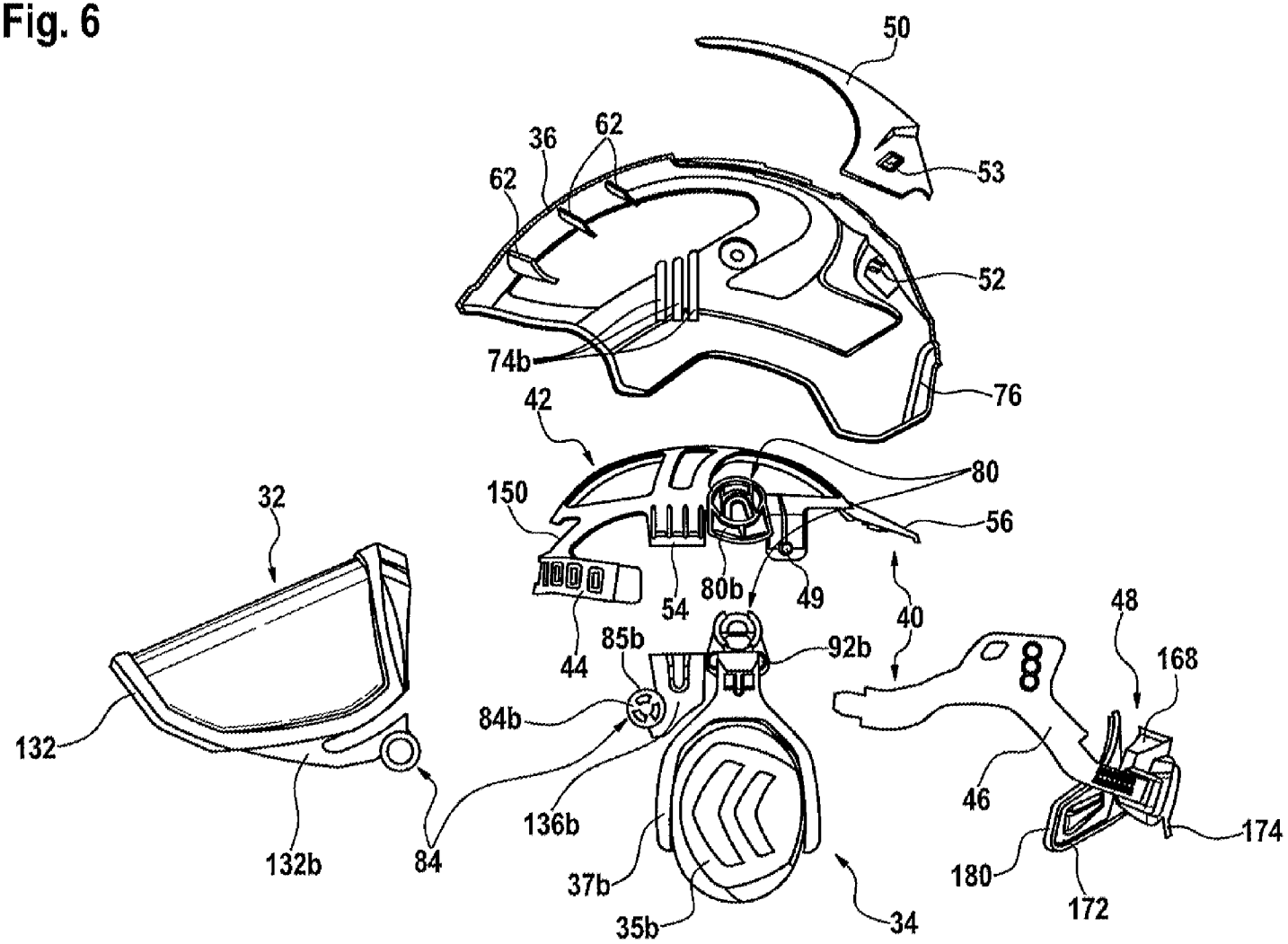
Figure 7:
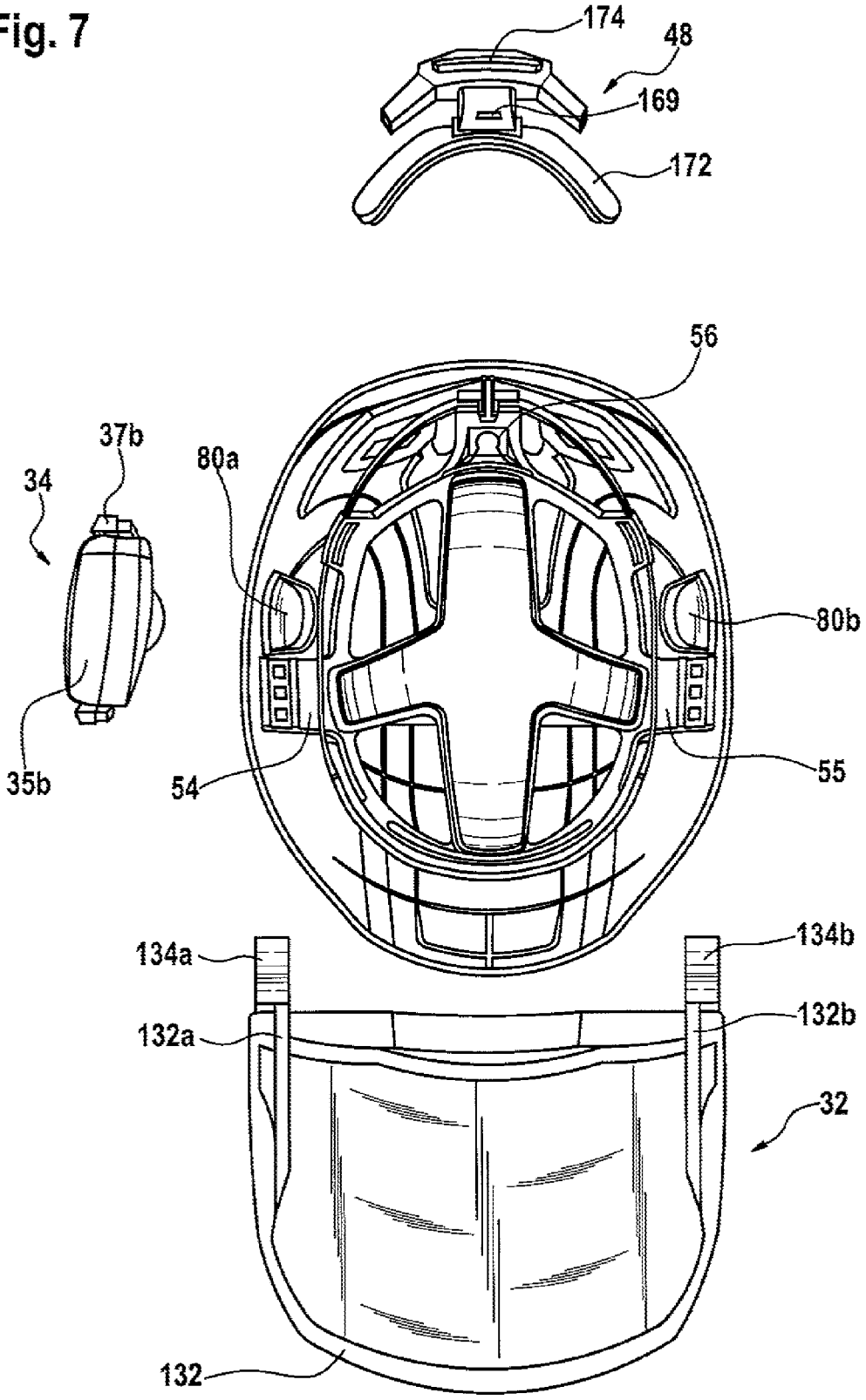
Figure 8:
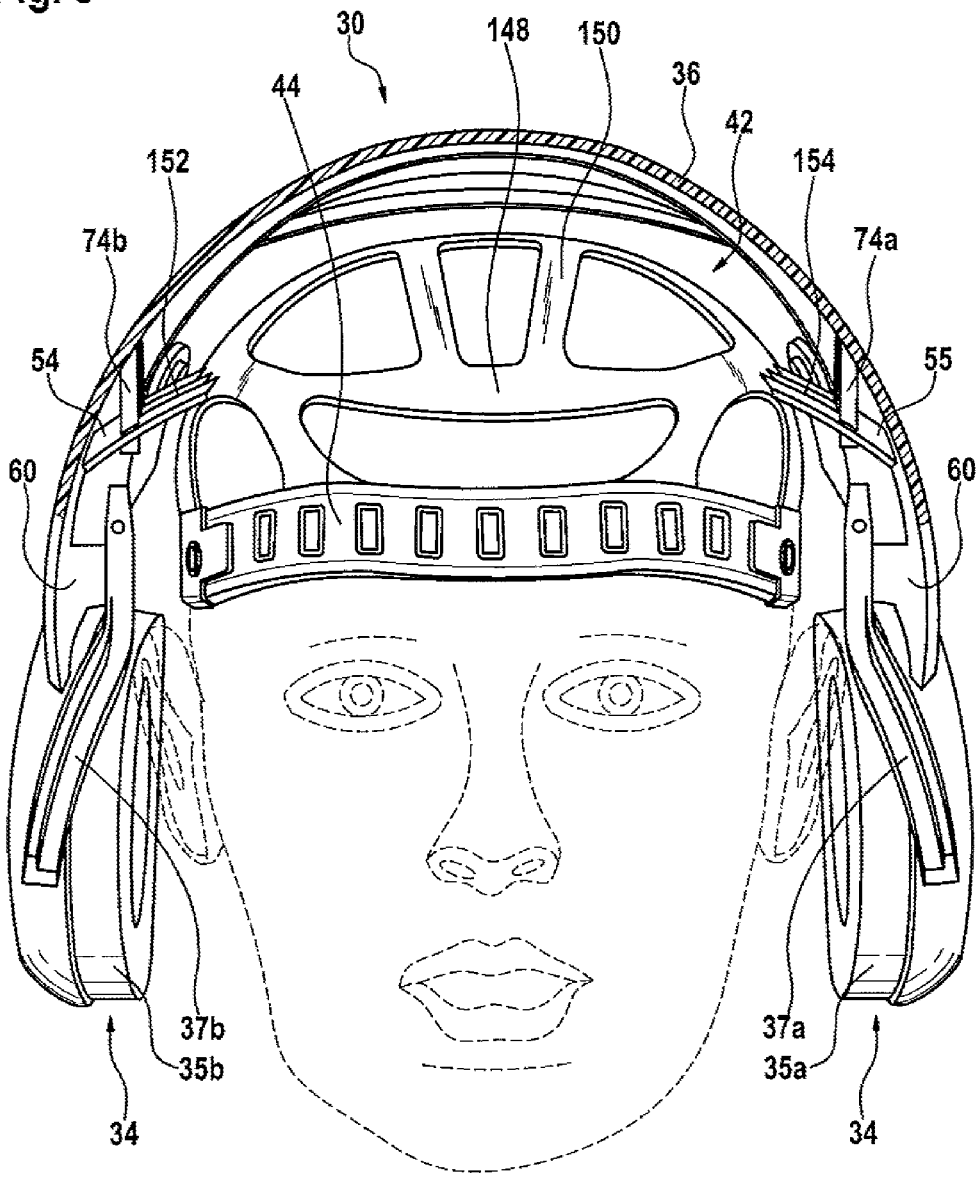
Figure 9:
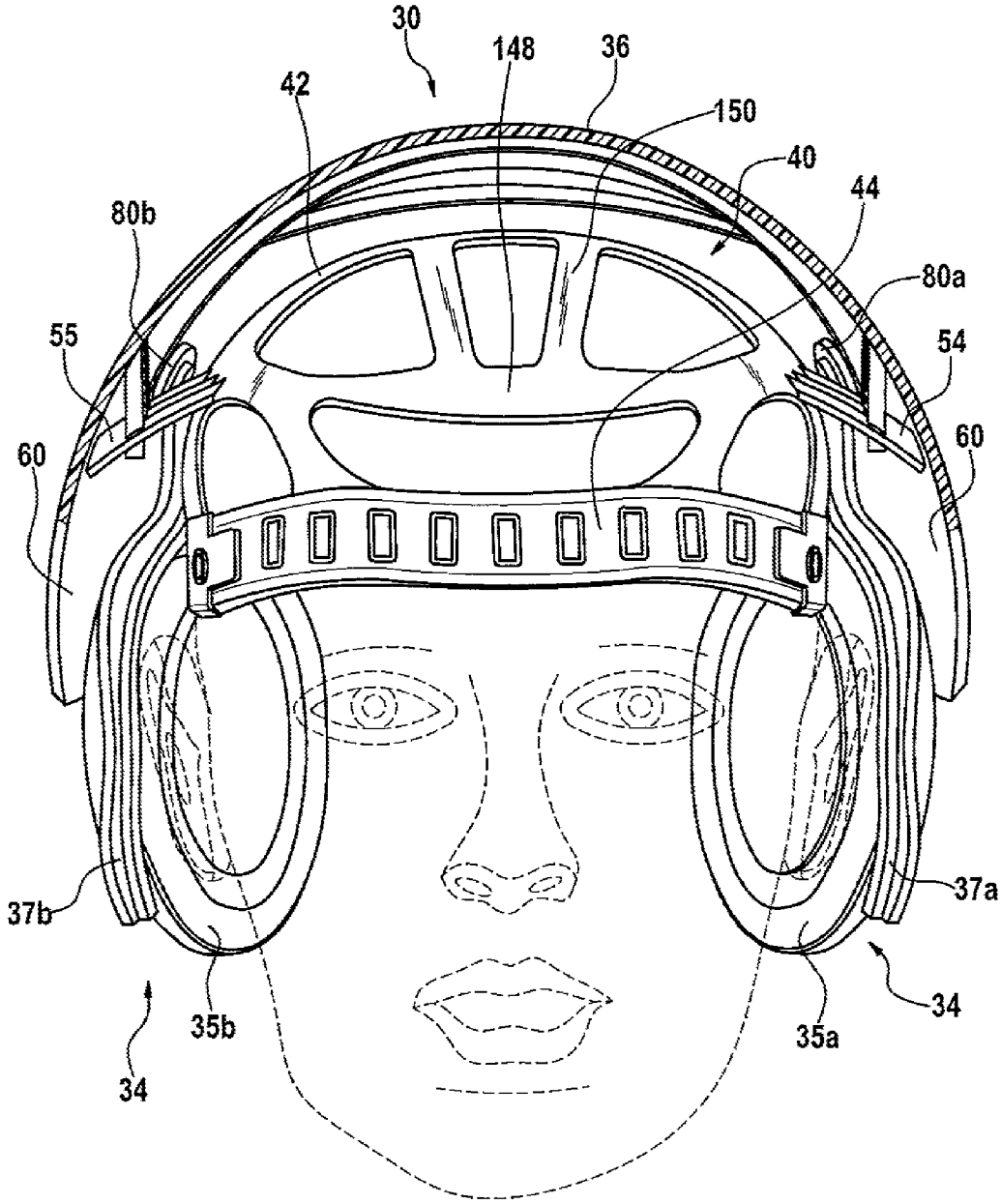
Figure 10:
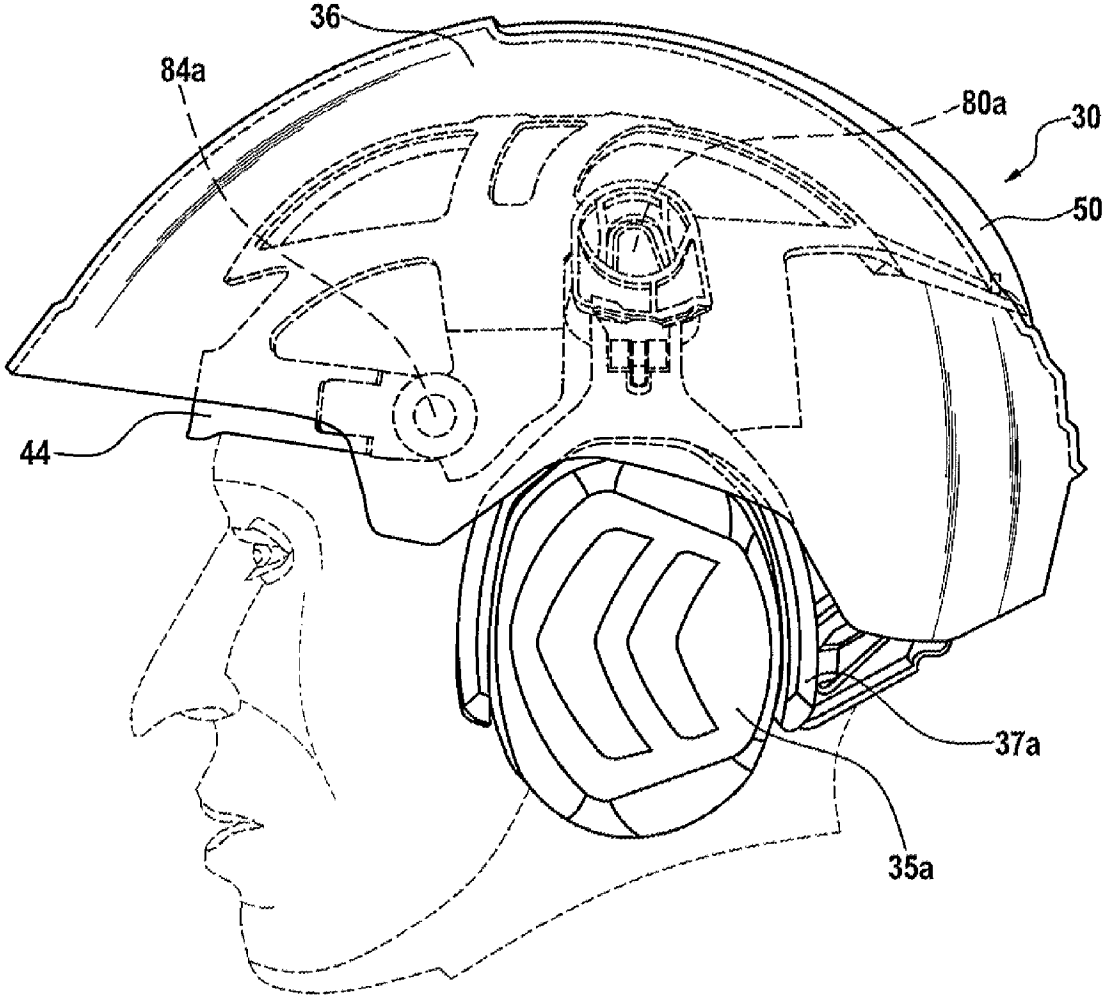
Figure 11:
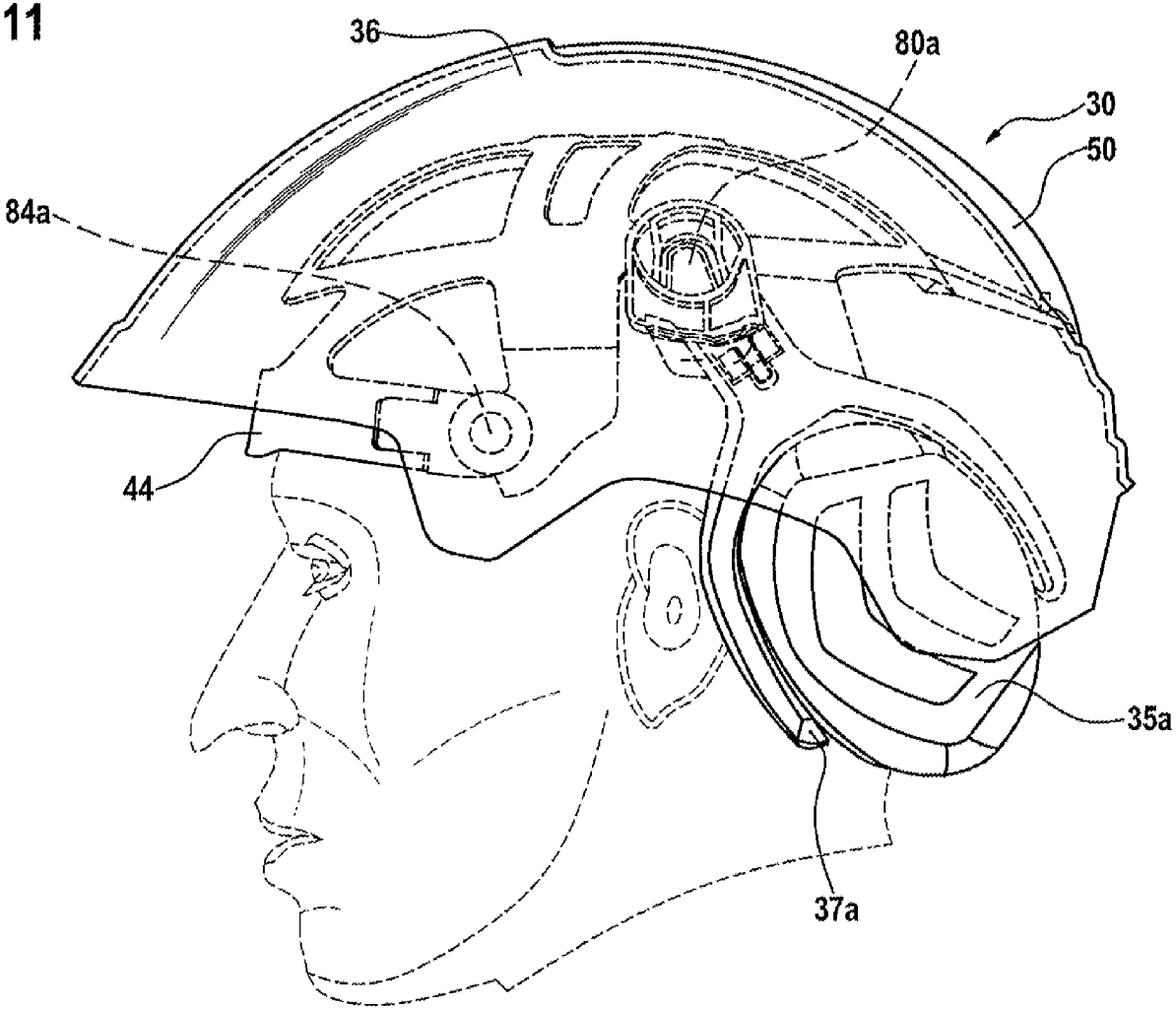
Figure 12:
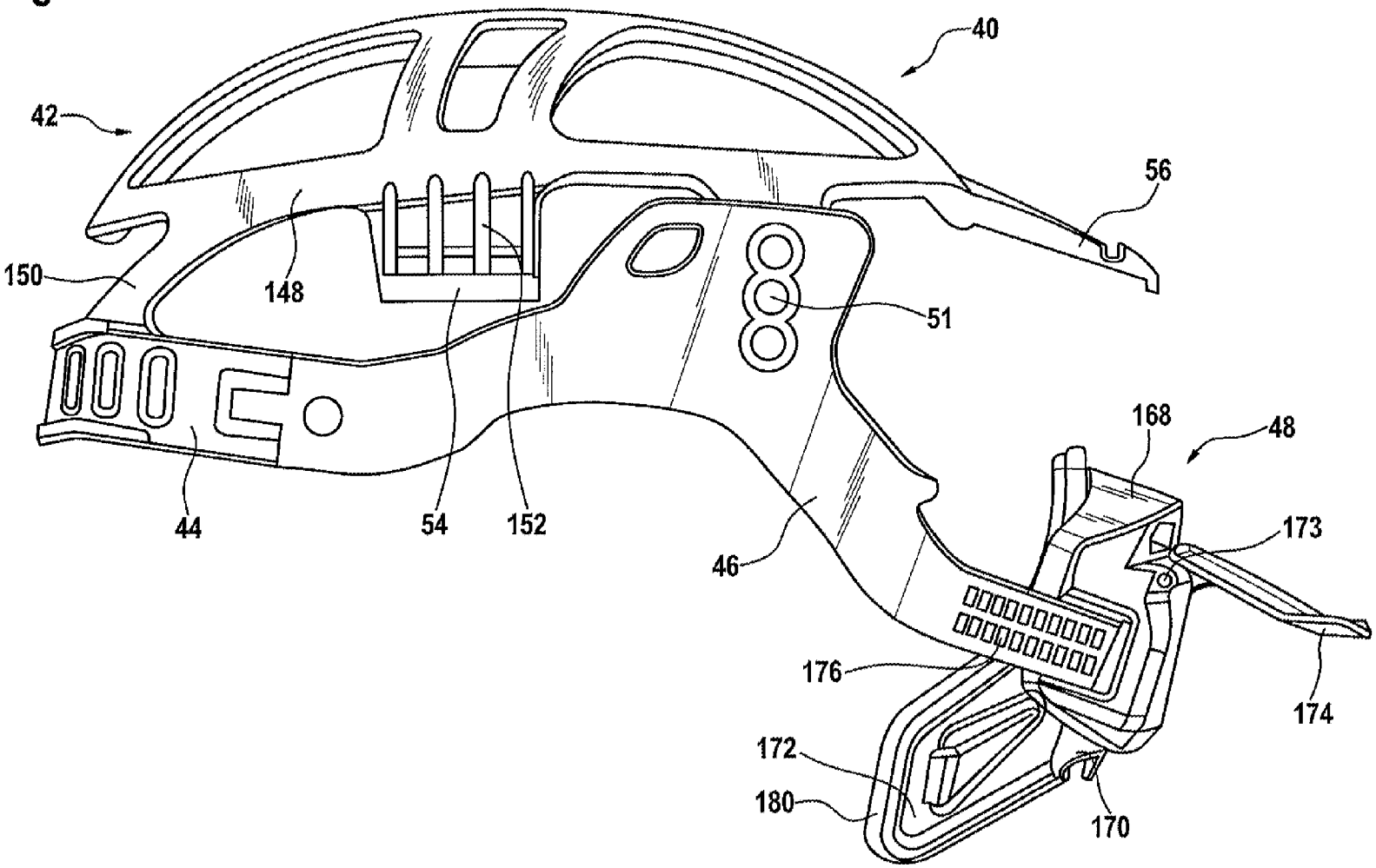
Figure 13:
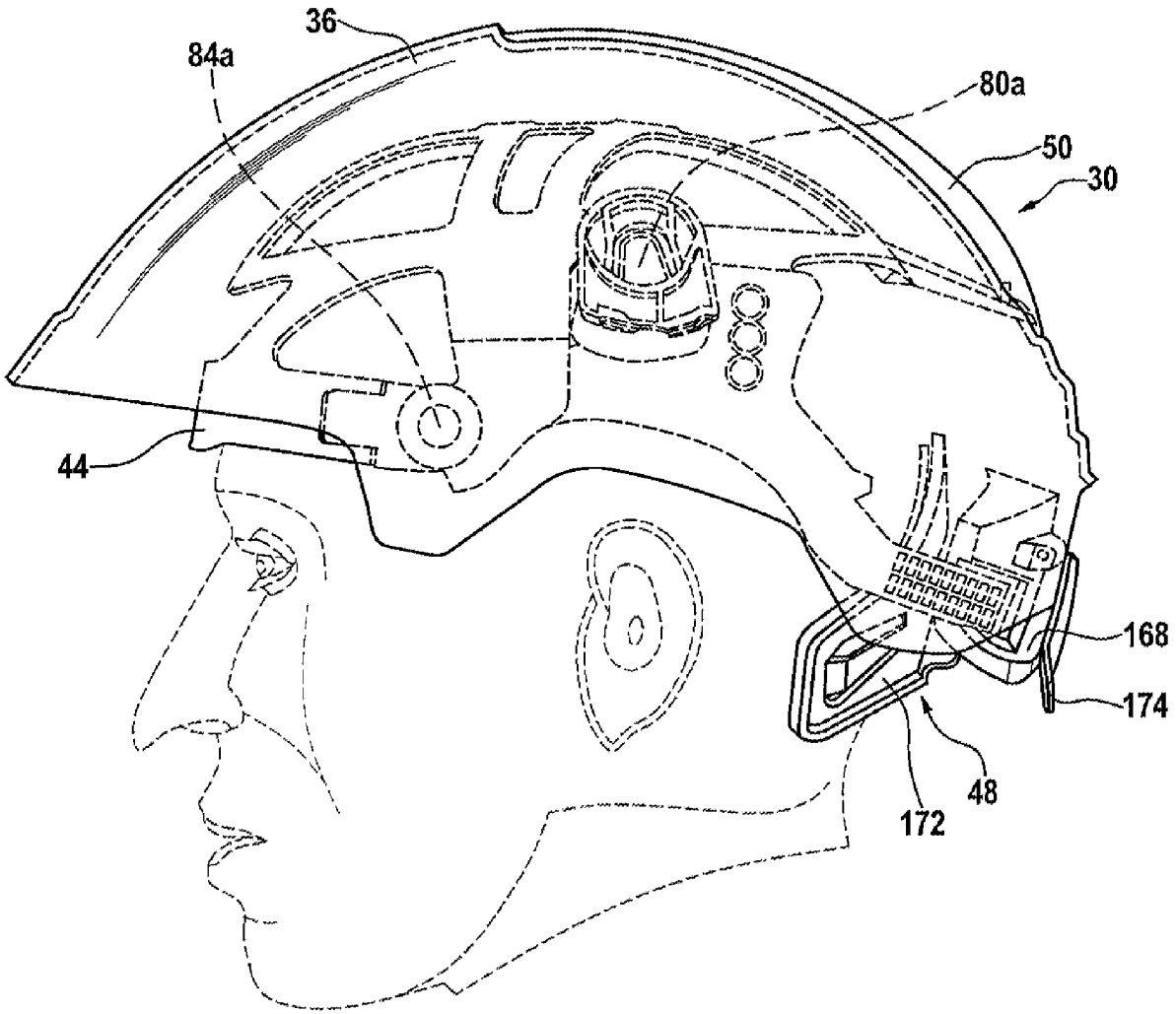
Figure 14:
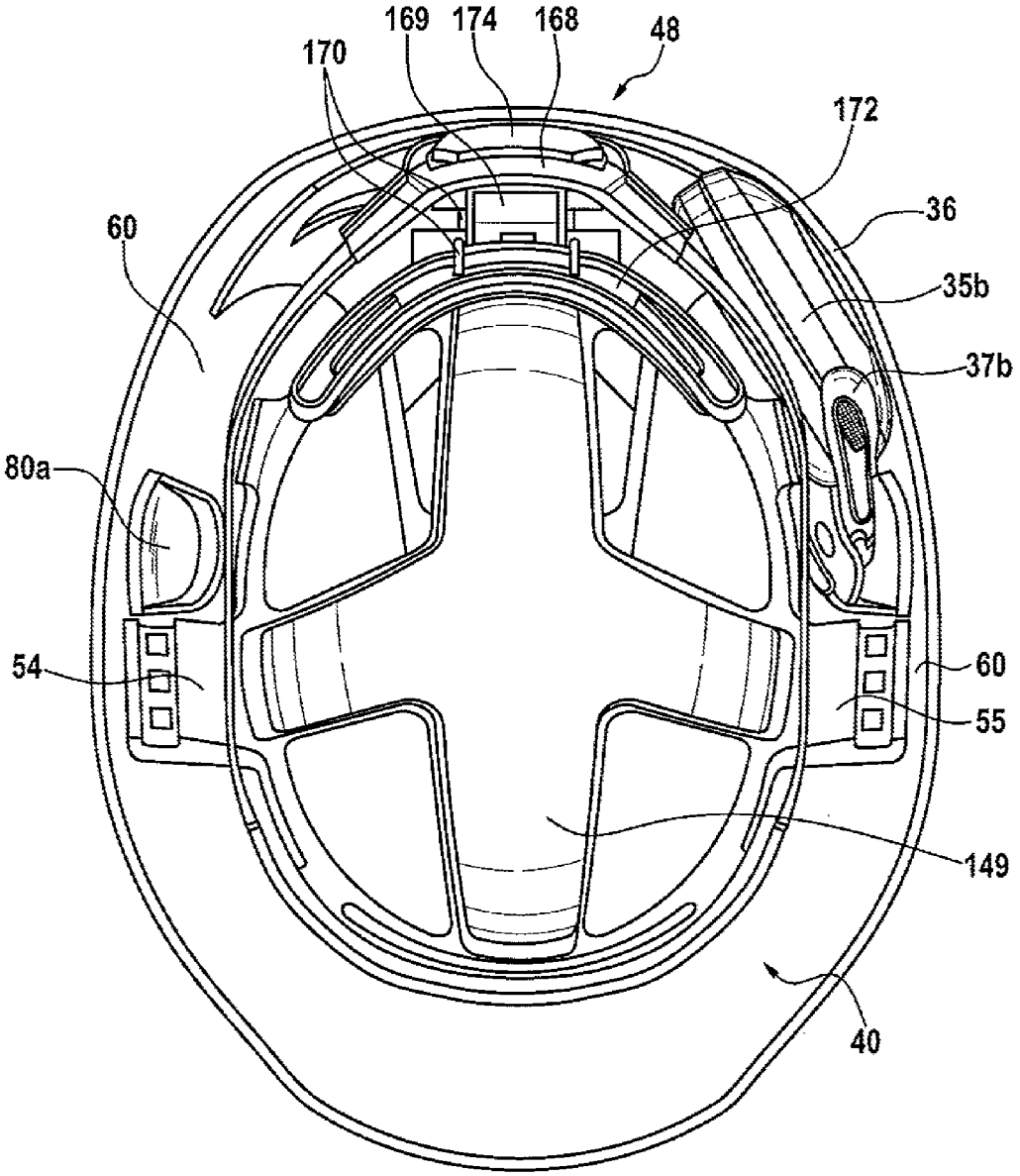
Figure 15:
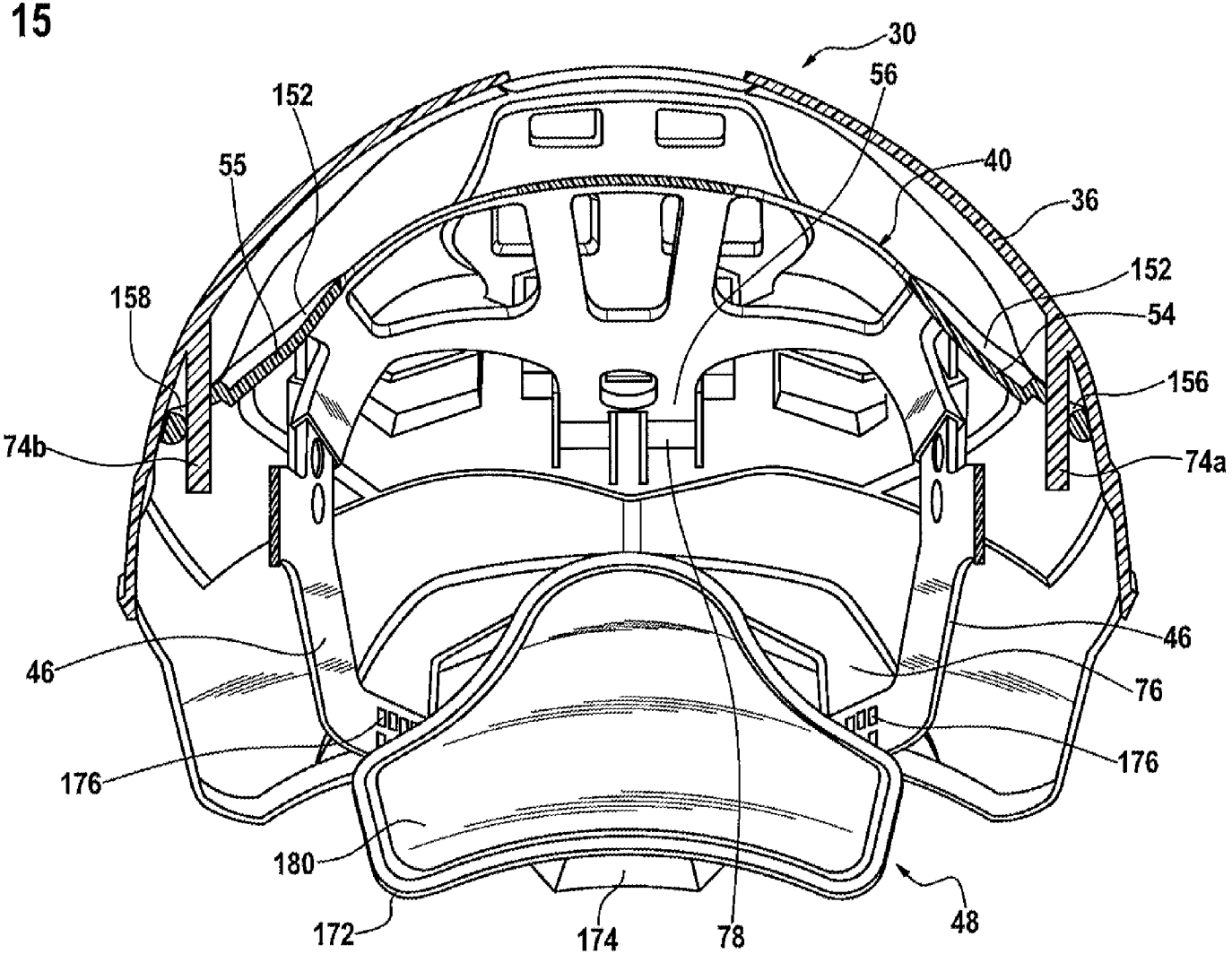
Figure 16:
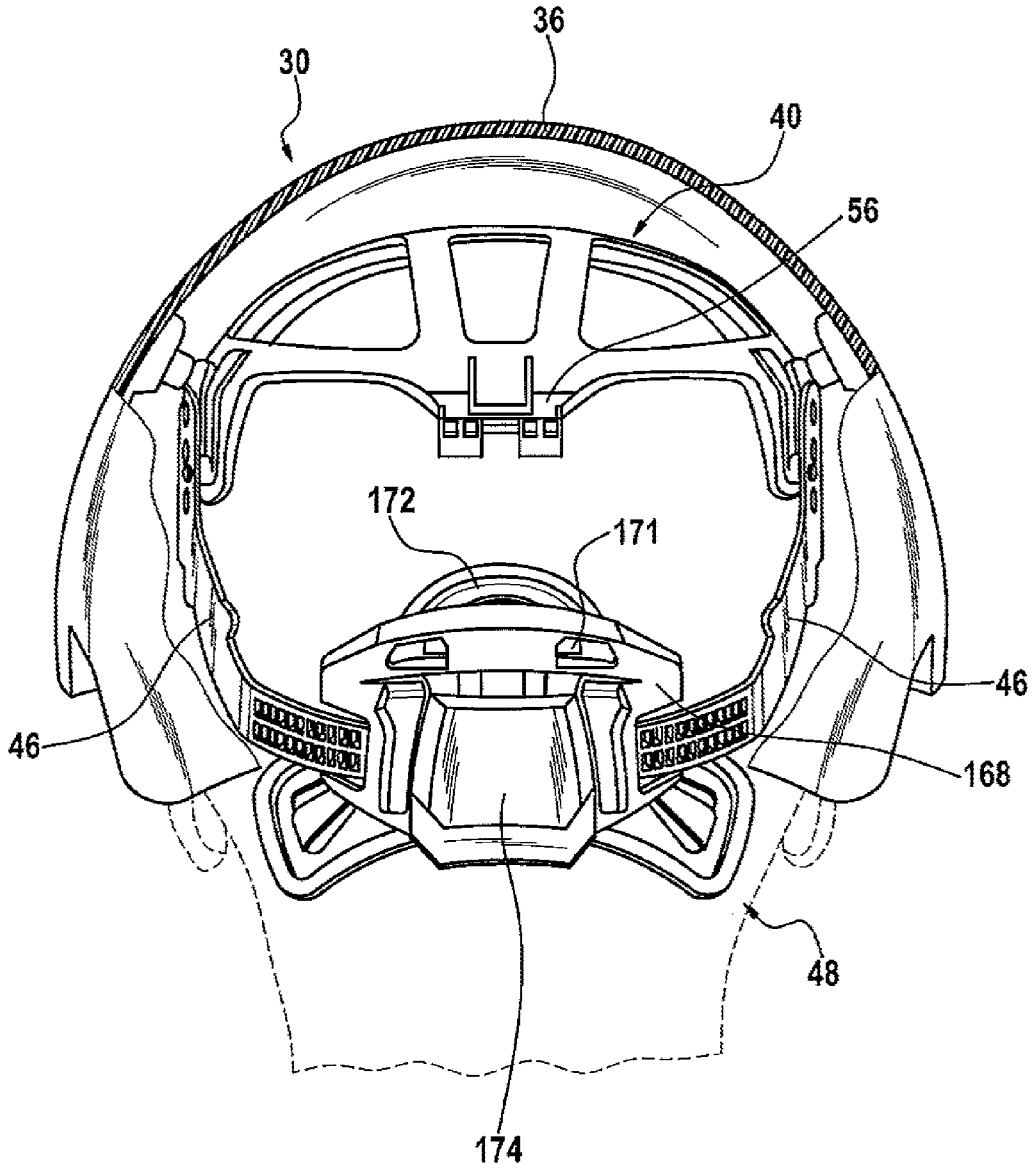
Figure 17:
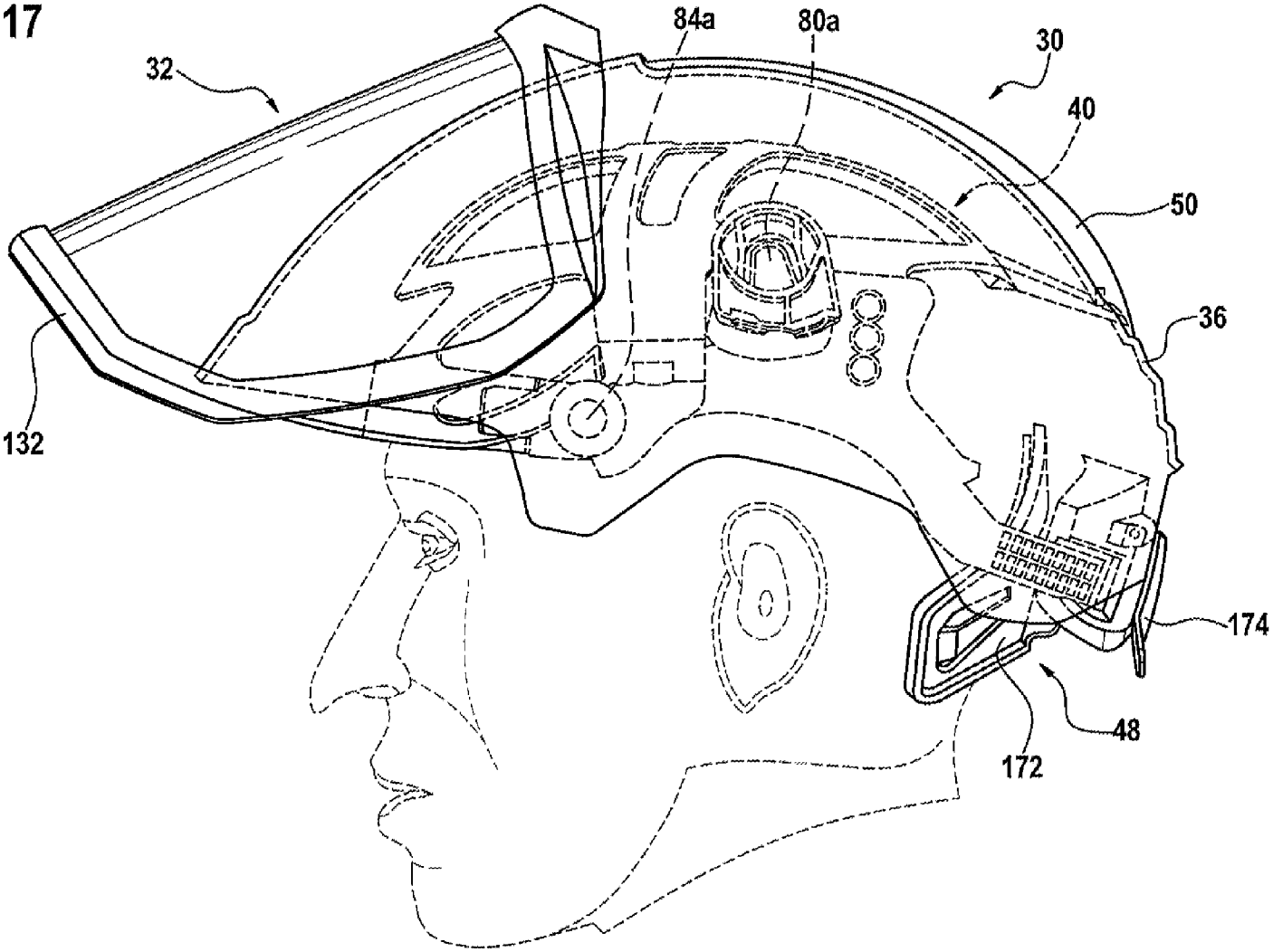
Figure 18:
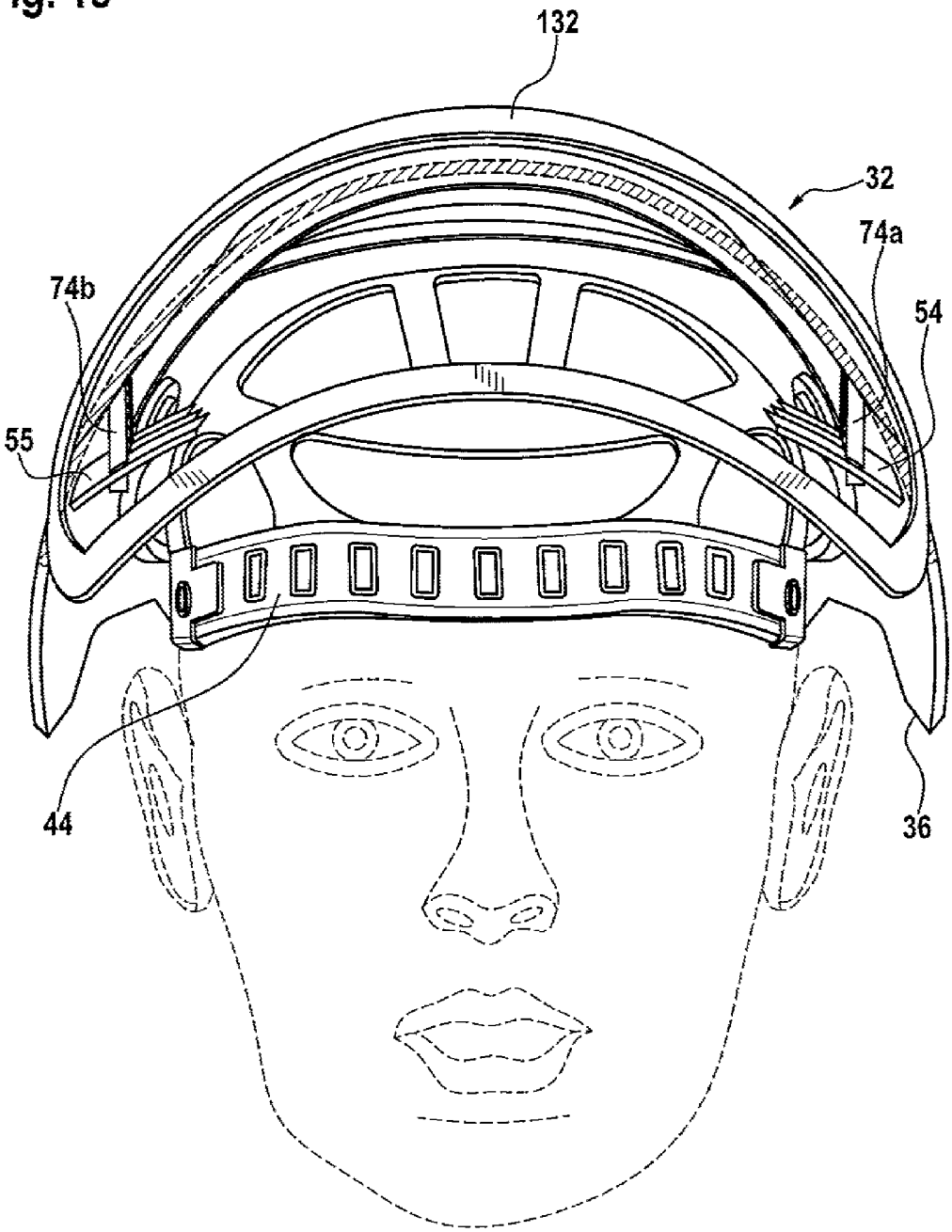
Figure 19:
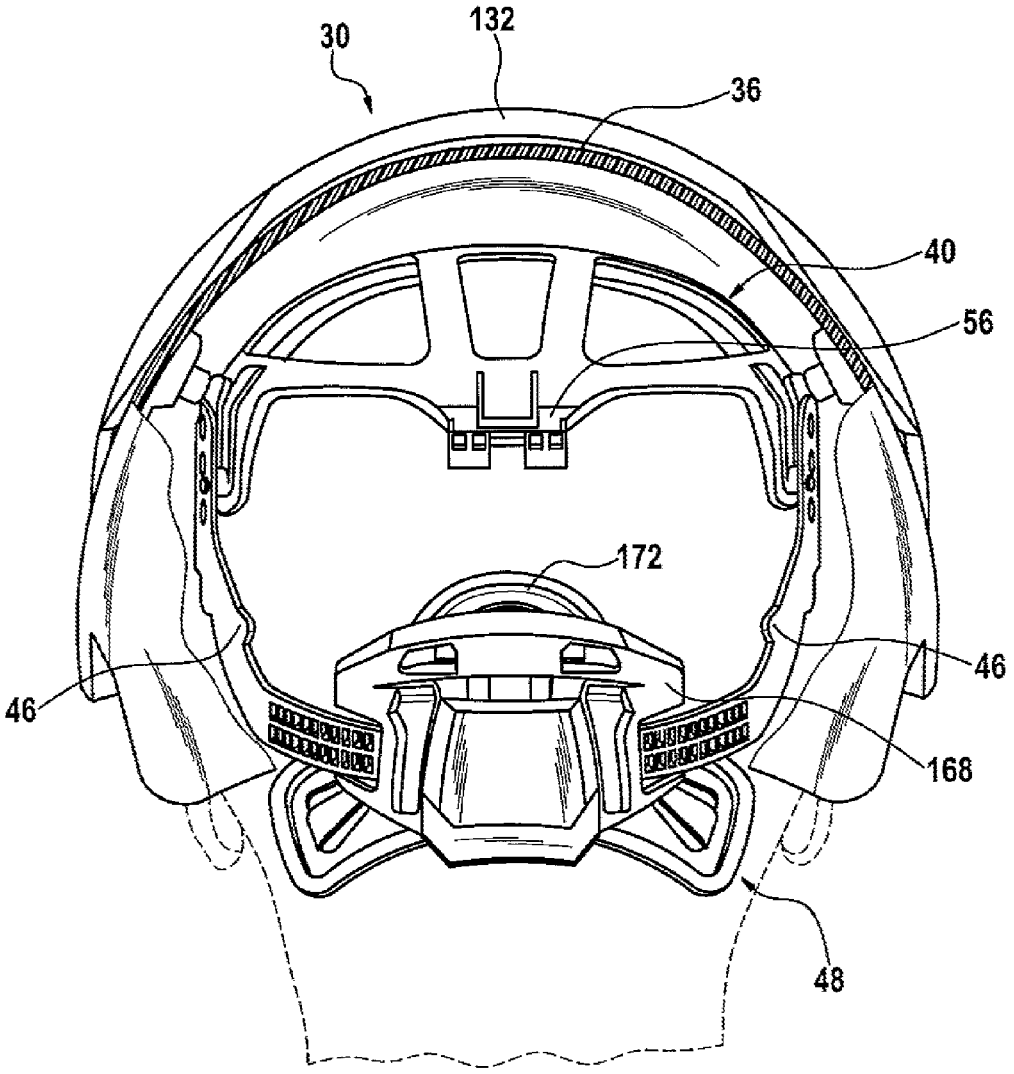
Figure 20:
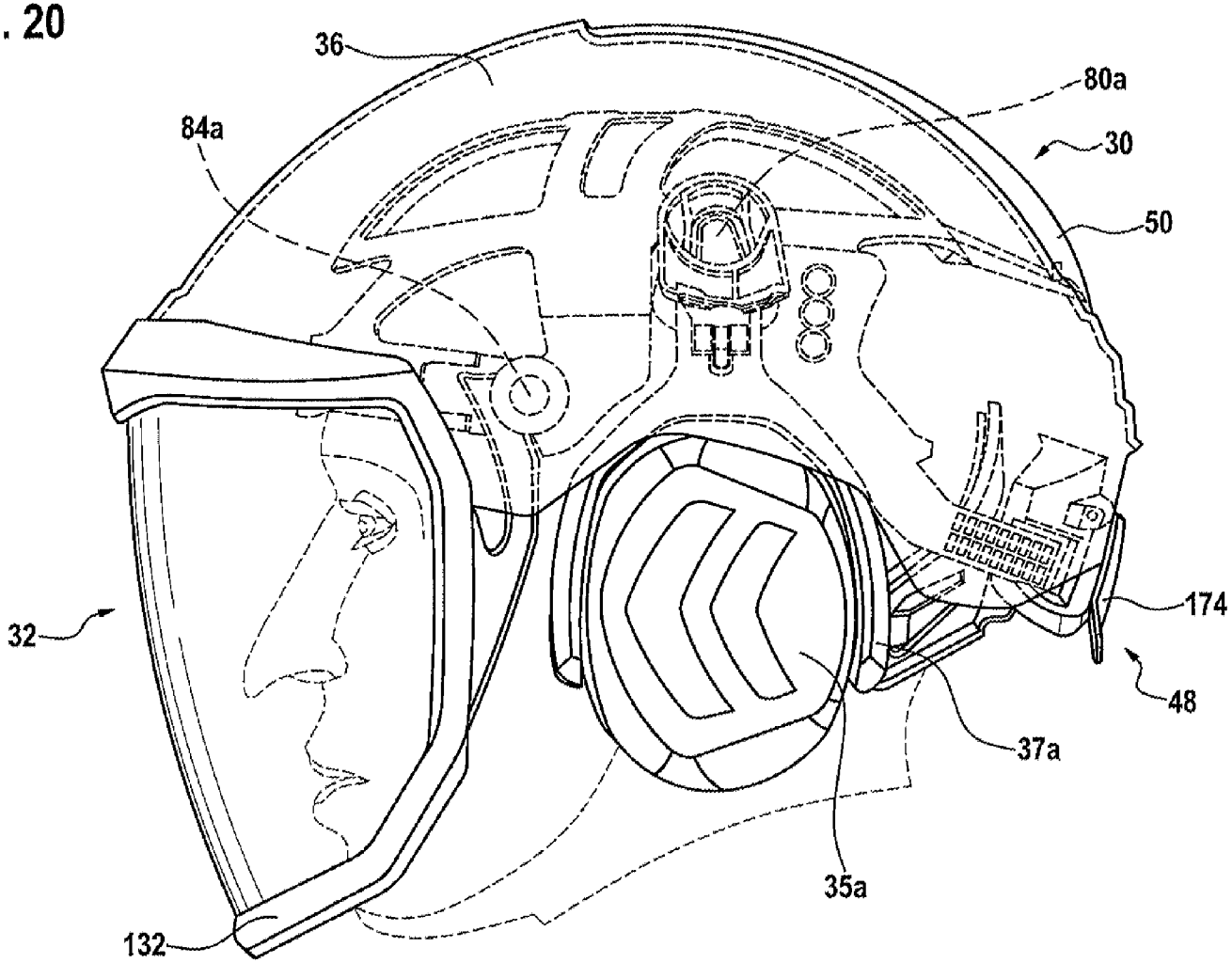

In the following, embodiments of the invention will be described in more detail with reference to the drawings in which:

FIG. 1 shows a perspective representation and an inclined view from below of an interior fitting subassembly of a protective helmet according to the invention, FIG. 2 shows the interior fitting subassembly according to FIG. 1 in an inclined view from above, FIG. 3 shows a longitudinal sectional view of the interior fitting subassembly according to FIG. 1 mounted in a helmet shell of the protective helmet according to the invention also shown in a longitudinal section, FIG. 4 shows the helmet shell according to FIG. 3 without the interior fitting subassembly in a view from below, FIG. 5 shows a perspective representation of the helmet shell according to FIG. 4 in an inclined view from below, FIG. 6 shows an exploded, partly cross sectional view of an embodiment of the protective helmet according to the invention in which it is provided with a face and ear protection, FIG. 7 shows the protective helmet according to FIG. 6 in a bottom view in which the face protection, a tightening unit and an ear protection are shown in a distance from the helmet, FIG. 8 shows an embodiment of the protective helmet according to the invention in which it comprises an ear protection, the helmet shell being shown in a cross section and the ear protection pivoted away from the ears, FIG. 9 shows the protective helmet according to FIG. 8, the ear protection, however, being shown pivoted onto the ears, FIG. 10 shows a side view of the protective helmet according to FIG. 9, FIG. 11 shows the protective helmet according to FIG. 10, the ear protection, however, being shown pivoted into a parking position and accommodated under the helmet shell, FIG. 12 shows the interior fitting subassembly of the protective helmet according to the invention, two ends of a neck band being releasably connected in the neck area by means of a tightening unit, FIG. 13 shows the interior fitting subassembly according to FIG. 12 mounted in the helmet shell in a side view of the protective helmet according to the invention, FIG. 14 shows the protective helmet according to FIG. 13 in a view from below, FIG. 15 shows a cross sectional view of the protective helmet according to FIG. 13 when viewed in a rearward direction, FIG. 16 shows a partly broken representation of the protective helmet according to FIG. 13 when viewed in a forward direction, FIG. 17 shows the protective helmet according to FIG. 13 which is, in addition, shown with a visor as a face protection, the visor being opened, FIG. 18 shows a cross sectional view of the protective helmet according to FIG. 17 when viewed in a rearward direction, FIG. 19 shows a broken representation of the protective helmet according to FIG. 17 when viewed in a forward direction, and FIG. 20 shows a side view of an embodiment of a protective helmet according to the invention provided with a face protection, an ear protection and a tightening unit attached to a neck band in the area of the back of the head.

An embodiment of a protective helmet according to the invention designated by 30 as a whole and formed particularly for the use in forestry is shown in a side view in FIG. 20 and in an exploded, partially sectional view in FIG. 6. The protective helmet 30 comprises a face protection designated by 32 as a whole and an ear protection designated by 34 as a whole. The protective helmet 30 further comprises a helmet shell 36 and an interior fitting subassembly designated by 40 as a whole and comprising a supporting cage 42, a head band 44 and a neck band 46. The neck band 46 is provided with a tightening unit designated by 48 as a whole. The helmet shell 36 is provided with a ventilation slide 50 on the outside by means of which ventilation orifices 52 formed in the helmet shell can be opened and closed.

Three supporting arms 54, 55 and 56 formed as spacers of which the supporting arm 55 is not visible in FIG. 6 serve as a means for a three-point fastening of the interior fittings or the interior fitting subassembly 40 to the helmet shell 36. The helmet shell 36 is dimensioned so (i.e. dimensioned so long and so broad in its inner width) and the supporting arms 54, 55 and 56 are dimensioned and arranged so that, between the interior fitting subassembly 40 and the helmet shell 36, a clearance 60 is present for accommodating ear protection capsules 35*a*, 35*b* of the ear protection 34 and other helmet accessories as well as mounting devices for at least the face protection 32 and the ear protection 34. The other helmet accessories include the abovementioned tightening unit 48 of the neck band 46.

In the following the helmet shell 36, the interior fitting subassembly 40, its connection to the helmet shell 36 and then the helmet accessories comprising the ear protection 34, the face protection 32 as well as their mounting devices and the tightening unit 48 will be described in detail and in this order.

In the following, the helmet shell 36 will be described in detail with reference to the drawings, particularly to FIGS. 3-7 and 15.

The helmet shell 36 is formed as an integrally formed plastics moulding. A suitable plastic material for the helmet shell 36 is, for example, ABS. In FIG. 3, a longitudinal sectional view of the helmet shell 36 equipped with the interior fitting subassembly 40 is shown. FIG. 4 shows the helmet shell 36 according to FIG. 3 without the interior fitting subassembly 40 in a view from below. FIG. 5 shows a perspective representation of the helmet shell according to FIG. 4 in an inclined view from below. FIG. 6 shows an exploded, partially sectional view of the protective helmet 30, the helmet shell 36 and, above it, the ventilation slide 50 being visible being visible in this representation from above. FIG. 7 shows a bottom view of the protective helmet 30 according to FIG. 6 in the assembled state in which the face protection 32, the tightening unit 48 and the ear protection 34 are shown in a distance to the helmet. The helmet shell 36 is drawn forward to an extent that it also fulfills the function of a peak above the eyes. In this way the helmet shell 36 has, in its front section, a uniformly ascending outer surface without any considerable gradation in the backward direction so that it does not offer any catching points to obstacles such as branches. On the inner surface of the helmet shell 36 transversely extending reinforcement ribs 62 are integrally formed in the front and in the central section of the helmet. Transverse to the reinforcement ribs 62 and centrally reinforcing rib 64 extending in the longitudinal direction of the protective helmet 30 is formed. The reinforcement ribs 62 and 64 are best seen in FIGS. 3 and 4. In the central area the reinforcement ribs 62, 64 connect to an area slightly deepening towards the inside and comprising six sets of ventilation orifices 52. In the deepened area the ventilation slide 50 engaging in two front guiding slots 66 with retaining knobs 68 protruding downwards and inwards and in two rear guiding slots 72 with two retaining knobs 70 is shiftably located on the outer surface of the helmet shell 36. The ventilation slide 50 has congruent ventilation orifices 53 (FIG. 6) located above the ventilation orifices 52 in the ventilation position and disposed in a shifted position so that the ventilation orifices 52 are closed by the ventilation slide 50 in the closed position. The lower edge of the helmet 30 is laterally drawn downwards in the area of the temples and in the area of the back of the head as can be seen in FIGS. 5 and 11. In this way the abovementioned clearance 60 between the interior fitting subassembly 40 and the helmet shell 36 is enlarged downwards in these areas. In this way the mounting of mounting devices to the inside of the helmet shell 36 and the accommodation of the ear protection capsules 35*a*, 35*b* in the clearance 60 is facilitated which is illustrated in the representation in FIG. 11 and described in in more detail below.

In the abovementioned temple area three rod-like protrusions 74*a* or 74*b* to which the interior fitting subassembly 40 including the supporting arms 54 or 55 can be positively and releasably attached are integrally formed on each side of the inside of the helmet shell 36. The rod-like protrusions 74*a*, 74*b* can be seen in a side view in FIG. 5, in a plan view in FIG. 4 (on the right side) and in a sectional view in FIG. 15. The rod-like protrusions 74*a*, 74*b* are, in the cross-section, square hollow profiles, respectively, the base section of which is integrally formed on the inside of the helmet shell 36. In their sector opposing the base section the rod-like protrusions 74*a*, 74*b* are arranged so that they stand freely in front of the inner surface of the helmet shell 36. The connection of the rod-like protrusions 74 to the inside of the helmet shell 36 and their transition to the helmet shell in the area adjacent to the connecting point in a respectively triangular knuckle is stiffened by additional integrally formed ribs between the rod-like protrusions 74*a*, 74*b* and the helmet shell 36 so that the rod-like protrusions 74*a*, 74*b* are substantially rigidly connected to the helmet shell 36. If a force transverse to their longitudinal direction and aiming at bending the rod-like protrusions is applied to the rod-like protrusions 74*a*, 74*b* the rod-like protrusions 74*a*, 74*b* aim at deforming the helmet shell 36 correspondingly. The purpose of this design is explained in more detail in connection with the description of the attachment of the interior fitting subassembly 40 to the helmet shell 36 further below.

At the centre of the rear end the helmet shell 36 is provided with a recess 76 at the lower edge behind which the tightening unit 48 of the neck band 46 is located so as to be accessible for a manual operation for tightening or releasing the neck band 46 when the helmet 30 is fully assembled.

To lock the supporting arm 56 on the helmet shell 36 it is provided with a slot 78 in the area of the back of the head in which the appropriately formed free end of the supporting arm 56 (FIG. 2) can releasably engage as shown in FIGS. 7 and 15. If the supporting arm 56 is engaged the protrusions 56*a*, 56*b* formed on the supporting arm 56 are located outside of the helmet shell 36 and abut to its outer surface so that a tensile load is applied to the supporting arm 56 when a force acts on the helmet shell 36 from above.

A mounting device 80 for the ear protection 34 comprises two ear protection supporting points 80*a*, 80*b* on the inside of the helmet shell 36. The ear protection supporting points 80*a*, 80*b* are pivot bearings integrally formed on the inside of the helmet shell 36 or, preferably, non-releasably mounted as additional parts. On the ear protection supporting point 80*a*, 80*b*, supporting brackets 37*a*, 37*b* including ear protection capsules 35*a* or 35*b* are pivotably supported as described in more detail further below.

A mounting device 84 for the face protection 32 is provided with two face protection supporting points 84*a*, 84*b* on the inside of the helmet shell 36. In the face protection supporting points 84*a*, 84*b* two support arms 132*a*, 132*b* of a visor 132 are pivotably supported. The face protection supporting points 84*a*, 84*b* are not integrally formed on the inside of the helmet shell 36 but respectively fit onto a connector 136*a* or 136*b* respectively snapped on the rod-like protrusions 74*a* or 74*b* to thereby simultaneously fix the free ends of the supporting arms 54, 55 on the rod-like protrusions. The face protection supporting points 84*a*, 84*b* including the connectors 36*a* or 36*b* allocated to them are located in the clearance 60 in the mounted state, namely in an area in which the helmet shell 36 is drawn downward at its lower edge as already explained above.

The interior fittings for the protective helmet 30 will be described in detail below with reference to the drawings, particularly FIGS. 1-3, 6 and 12. The interior fitting subassembly 40 is that part of the protective helmet 30 which contacts the head and comprises the supporting cage 42, the head band 44 and the neck band 46 equipped with the tightening unit 48. The subassembly 40 can be attached to the helmet shell 36 shown in FIGS. 3 and 6 so as to support and fix the helmet 30 on the head of a wearer.

FIG. 1 shows the interior fitting subassembly 40 of the protective helmet 30 according to the invention in a perspective representation and in an inclined view from below. FIG. 2 shows the interior fitting subassembly according to FIG. 1 in an inclined view from above. FIG. 3 shows a longitudinal sectional view of the interior fitting subassembly 40 according to FIG. 1 mounted in the helmet shell 36 of the protective helmet 30 also shown in a longitudinal section. FIG. 6 shows an exploded, partially sectional representation of an embodiment of the protective helmet 30 in which it is provided with a face and an ear protection 32 or 34. FIG. 12 shows the interior fitting subassembly 40 of the protective helmet 30, two ends of the neck band 46 being releasably connected by the tightening unit 48 in the neck area.

The supporting cage 42 is formed of a stiff, elastically flexible material, preferably of a plastic material such as polyamide. The support head 42 is respectively provided with a rigid supporting arm 54, 55 or 56 protruding obliquely downwards or backwards in two temple areas as well as in an area of the back of the head to form a three-point mount of the interior fittings to the helmet shell 36 and for enabling the clearance 60 continuously extending around the interior fittings in the helmet shell 36 to accommodate ear protection capsules 35*a*, 35*b* and other helmet accessories as well as mounting devices 80, 84 for the face and the ear protection 32 or 34. The supporting cage 42 is produced as an integrally formed plastic moulding in the embodiment described here. The supporting cage 42 is formed of two pairs of mutually spaced apart support strips 142, 144 which, according to the representation in FIG. 2, intersect in the centre, their lower ends blending into a single, peripherally closed support strip 148 at four connection points 146*a*, 146*b*, 146*c*, 146*d*. In FIG. 1 the support strips 142, 144 are hidden by a cross-shaped piece of padding material 149.

The supporting arms 54, 55, 56 protrude from the supporting cage 42 at the connection points 146*a*, 146*b*, 146*c*. If it is assumed that the support strips 142 and 144 extend in a curve, preferably in a substantially circular arc, between the connection points 146*a*, 146*b* or 146*c*, 146*d* the supporting arms 54, 55 or 56 respectively protrude downwards or backwards from the supporting cage 142 so as to be substantially tangential to the related curve as can be seen in FIG. 15 or 2. In the embodiment described here the supporting arms 54, 55, 56 are integrally formed on the peripherally closed support strip 148. The head band 44 is integrally formed on the supporting cage 42 as shown in FIG. 2. The neck band 46 has two front ends releasably connected to free rear ends of the head band 44, for example by means of a snap-on connection not shown in detail in the Figures. The neck band 46 has, according to the representation in FIGS. 1 to 3, two free ends releasably connected to each other in the neck area, namely with the aid of the tightening unit 48 as can be seen in FIG. 12. The neck band 46 may be formed of the same material as the supporting cage 42. The neck band 46 is respectively connected to the supporting cage 42 between its connections to the head band 44 and its free ends so that it is adjustable in height as illustrated, for example, in FIGS. 1 and 2. To this end the supporting cage 42 comprises two support arms 47*a*, 47*b* protruding downwards on which the neck band 46 is respectively fixable at a selectable height. The neck band 46 has three holes 51 arranged above each other on each side which can be brought in engagement on a resilient bolt 49 protruding from each support arm 47*a*, 47*b* (FIG. 6) as illustrated in FIGS. 1 and 2.

In the embodiment described above, the supporting arms 54, 55 are actually attached to the helmet shell 36 in another way than the supporting arm 56, however, this is not essential. The supporting arms 54, 55 may also be fixed to the helmet shell in the same way as the supporting arm 56. It is only required that the supporting arms 54, 55 have fixation means identical to those of the supporting arm 56 which permit the supporting arms 54, 55 to be brought into a positive engagement with the helmet shell. In this case then the fixation means of the supporting arms 54, 55 would also be locking means which are, for example, inserted into slots in the helmet shell 36 to fix the supporting arms 54, 55 as well as the supporting arm 56 to the helmet shell by means of a locking connection.

The head band 44 is integrally formed on the peripherally closed support strip 148 via connecting strips 150 in a distance to the peripherally closed support strip 148. The supporting arms 54, 55, 56 and the support arms 47*a*, 47*b* are further reinforced by integrally formed ribs 152 or 154.

The supporting arms 54, 55 protruding downwards in the two temple areas comprise means for the fixation to the inside of the helmet shell 36. The fixation means comprise three through-holes 156 or 158 in each of the supporting arms 54, 55 which can be brought into a positive engagement with the rod-like protrusions 74*a* or 74*b* on the helmet shell 36. The supporting arm 56 of the supporting cage 42 protruding backwards in the area of the back of the head is provided with the protrusions 56*a*, 56*b* which, as already explained above, form a locking device for releasably attaching the interior fitting subassembly 40 to the helmet shell 36.

According to FIG. 2, finally, a device 88*a*, 88*b* for fixing a chin strap (not shown) is formed on the supporting cage 42. The chin strap fixation device 88*a*, 88*b* comprises two link pins 90*a*, 90*b* integrally formed on the peripherally closed support strip 148 of the supporting cage 42 adjacent to the supporting arms 54, 55 protruding downwards in the two temple areas or, as shown, on a connecting piece 89*a*, 89*b* snappable onto the peripherally closed support strip 148.

In industrial and forestry workers' helmets, the chin strap is fastened to the helmet shell (not shown) or to the supporting cage. In mountaineers' helmets the chin strap is only fixed to the helmet shell.

The mutual connection of the helmet shell 36 and the interior fitting subassembly 40 which was already partly described above will be explained in summary and complementary here with reference to FIGS. 2, 3 and 15. FIG. 2 shows the interior fitting subassembly 40 in a perspective representation and in an inclined view from above. FIG. 3 shows a longitudinal sectional view of the interior fitting subassembly 40 mounted in the helmet shell 36 of the protective helmet 30 also shown in a longitudinal section, the tightening unit 48 on the neck band 46 not being shown.

FIG. 15 shows a sectional view of the protective helmet 30 along the line XV-XV in FIG. 3, the tightening unit 48 also being shown. In FIG. 2, the supporting arms 55 and 56 formed as spacers can be seen. The second supporting arm 55 protruding downwards cannot be seen in FIG. 2. The supporting arm 55 is shown in an interior view in FIG. 3. In FIG. 15 the supporting arms 54 and 55 are shown in a sectional view. For a three-point attachment of the interior fitting subassembly 40 to the helmet shell 36 the supporting arm 56 protruding backwards is inserted into the slot 78 in the helmet shell until the protrusions 56*a*, 56*b* engage on the outside of the helmet shell. Then the interior fitting subassembly 40 is moved further inwards in the direction of the inner surface of the helmet shell 36, the supporting arms 54 and 55 being slipped over the rod-like protrusions 74*a* or 74*b*. At the same time the through-holes 156 and 158 in the supporting arms 54 and 55 positively accommodate the rod-like protrusions 74*a* or 74*b* as can be seen in FIG. 15. If the supporting arms 54, 55 abut on the interior surface of the helmet in the knuckle between the helmet shell 36 and the rod-like protrusions 74*a*, 74*b* the connectors 136*a* and 136*b* (FIGS. 4 and 5) are fitted onto the rod-like protrusions 74*a* or 74*b* to thereby fix the supporting arms 54 and 55 in their position. The interior fitting subassembly 40 and the helmet shell 36 are no fixedly connected to each other at three points. As soon as the protective helmet 30 is placed on the head and fixed to the head with the aid of the tightening unit 48, in addition, a chin strap (not shown) may also be tightened under the chin, if required. The through-holes 156, 158 in the supporting arms 54, 55 respectively encompass the rod-like protrusions 74*a* or 74*b* on a length at least equal to the inner width the through-holes 156, 158. If, due to a load acting on the helmet 30, a force is exerted on the supporting arms 54, 55, 56 from above a tensile load is applied to the supporting arms by the helmet shell 36 supported by the ends the supporting arms. A momentum aiming at deforming the helmet shell 36 inwards as far as to the lower edge is generated at each of the three points by this force acting on the supporting arms 54, 55, 56. The helmet shell 36 thus transforms part of the force acting on it into deformation energy and, in this way, reduces the force effect acting on the person wearing the helmet. The transmission of the momentum from the supporting arms 54, 55, 56 to the helmet shell 36 is further increased by the supporting arms being further reinforced by integrally formed ribs 152.

In the following, the ear protection 34 including its mounting device 80 will be described in more detail with reference to the drawings, particularly FIGS. 4-11. FIG. 4 shows the helmet shell 36 without the interior fitting subassembly 40 in a view from below, particularly the position of the ear protection supporting points 80*a*, 80*b* on the inside of the helmet shell 36 being discernible. FIG. 5 shows a perspective representation of the helmet shell 36 according to FIG. 4 in an inclined view from below. FIG. 6 shows an exploded, partially sectional view of the protective helmet 30, the ear protection 34 being shown in relation to the other helmet accessories. FIG. 7 shows a bottom view of the protective helmet 30 in which the ear protection 34 is shown in a distance to the helmet. The mirror-inverted ear protection 34 present on the opposite side of the helmet 30 was omitted in FIG. 7 for the sake of clarity. FIG. 8 shows the protective helmet 30 including the ear protection 34 present on both sides, the helmet shell 36 being shown in a cross-sectional view and the ear protection 34 being shown when pivoted away from the ears. FIG. 9 shows the protective helmet according to FIG. 8, the ear protection 34, however, being shown when pivoted onto the ears. FIG. 10 shows a side view of the protective helmet according to FIG. 9. FIG. 11 shows the protective helmet according to FIG. 10, the ear protection 34, however, being shown when pivoted backwards into a parking position and accommodated under the helmet shell.

The ear protection 34 comprises two ear protection capsules 35*a*, 35*b* which are, respectively, pivotably supported in a fork-like supporting bracket 37*a* or 37*b*. The helmet shell 36 is provided with the fixed ear protection supporting point 80*a*, 80*b* at its inner side as can be seen in FIG. 4. In FIG. 6 the ear protection supporting point 80*b* is, in fact, illustrated together with the supporting cage 42, however, this supporting point is, like the ear protection supporting point 80*b*, attached to the inside of the helmet shell 36 and not to the supporting cage 42. The representation in FIG. 6 is only to illustrate where in space the ear protection supporting point 80*b* is located in relation to the supporting cage 42 of the interior fitting subassembly 40. At the supporting points 80*a*, 80*b*, the supporting brackets 37*a*, 37*b* provided with the ear protection capsules 35*a* or 35*b* are pivotably supported as can be seen in FIGS. 10 and 11. The ear protection supporting points 80*a*, 80*b* and the supporting brackets 37*a*, 37*b* are arranged and formed so that the supporting brackets 37*a*, 37*b* are pivotable between two positions inside the clearance 60, an operating position shown in FIGS. 9 and 10 in which the ear protection capsules 35*a*, 35*b* cover the ears, and a parking position shown in FIG. 11 in which the ear protection capsules 35*a*, 35*b* are accommodated in the clearance 60 in the helmet shell 36.

Each supporting bracket 37*a*, 37*b* is formed so as to be spring-biased and bendable in an area between its two ends in which it extends within the clearance 60 so that the ear protection capsules 35*a*, 35*b* are respectively pivoted away from the ear in a non-bent posture of each supporting bracket 37*a*, 37*b* as shown in FIG. 8, and are respectively pivoted onto the ear in a bent posture of the supporting bracket 37*a*, 37*b* as shown in FIG. 9. If the protective helmet 30 is not positioned on the head the two ear protection capsules 35*a*, 35*b* respectively reach a position in the latter portion which is located substantially further inside than the ear each ear protection capsule 35*a*, 35*b* is to rest against. In other words, the mutual distance of the ear protection capsules is, in this case, substantially smaller than the mutual distance between the ears. In this way it is ensured that, when the helmet 30 is put on, the ear protection capsules 35*a*, 35*b* are maintained pressed onto the ears by means of the spring bias. The spring bias for bending each supporting bracket 37*a*, 37*b* between two defined positions is effected by a circularly bent yoke spring 92*a*, 92*b* (the latter can be seen in FIG. 6). Each supporting bracket 37*a*, 37*b* can be manually moved into a bent and a non-bent position. In each of these positions the yoke spring 92*a* or 92*b* causes an end position lock. The end position lock of the supporting brackets 37*a*, 37*b* is not reached when the helmet is put on because, as stated, each ear protection capsule 35*a*, 35*b* is to be held elastically pressed onto the ear.

Furthermore, each ear protection supporting point 80*a*, 80*b* and each supporting bracket 37*a*, 37*b* are formed so that the supporting bracket can only be pivoted backwards from the position shown in FIG. 8. In this way it is ensured that the ear protection capsules 35*a*, 35*b* can be accommodated in the clearance behind the ear without colliding with the ears and the lower edge of the helmet shell 36.

In the following, the face protection 32 will be described in more detail with reference to the drawings, particularly FIGS. 6, 7 and 17-20. FIG. 6 shows the protective helmet 30 in an exploded and partially sectional representation, the face protection 32 being illustrated in relation to the other helmet accessories. FIG. 7 shows a bottom view of the protective helmet 30 in which a visor 132 of the face protection 32 is illustrated in a distance to the helmet. FIG. 17 shows the protective helmet 30, the visor 132 being opened. FIG. 18 shows a cross sectional view of the protective helmet according to FIG. 17 when viewed in a backwards direction. FIG. 19 shows the protective helmet according to FIG. 17 in of a broken representation when viewed in a forward direction. FIG. 20 shows a side view of an embodiment of the protective helmet 30 provided with the ear protection 34 and a tightening unit 48 attached the neck band 46 in the area of the back of the head in addition to the face protection 32.

The face protection 32 comprises the visor 132 comprising the two support arms 32*a*, 32*b* as well as two connectors 136*a*, 136*b* on which a face protection supporting point 84*a* or 84*b* is integrally formed as a mounting device 84 for the face protection 32, respectively. The connectors 136*a*, 136*b* are fitted on the rod-like protrusions 74*a* or 74*b* whereby the face protection supporting points 84*a*, 84*b* come to be positioned in the temple area on the inside the helmet shell 36. The connectors 136*b* including the face protection supporting point 84*b* can be seen in FIG. 4. The connectors 136*a* located on the opposite side and including the face protection supporting point 84*a* is not shown in FIG. 4. Each face protection supporting point 84*a*, 84*b* comprises three axially protruding, elastically flexible tappets 85*a* or 85*b* via which the support arms 132*a*, 132*b* including ring-shaped bearing bushes 134*a*, 134*b* are shiftable to releasably and pivotably fix the support arms 132*a*, 132*b* in the face protection supporting points 84*a*, 84*b*. The face protection supporting points 84*a*, 84*b* and the support arms 132*a*, 132*b* are arranged and formed so that each support arm 132*a*, 132*b* is pivotable between two positions within the clearance 60, an operating position in which the visor 132 is closed and protects the face (FIG. 20), and a parking position in which the visor 132 is open and positioned on the outer surface of the helmet shell 36 so as to be closely abutting to it (FIGS. 17 and 19). The mounting device 84 for the face protection comprises a self-retaining mount for each support arm 132*a*, 132*b*. For this purpose, each connector 136*a*, 136*b* contains a spring-biased bolt retaining the ring bearing bushing 134*a* or 134*b* attached to the support arms 132*a*, 132*b* in the operating position or in the parking position in an elastically biased state.

The visor 132 forms a fork together with each support arm 132*a*, 132*b* (FIG. 6) in which the wall of the helmet shell 36 is tightly accommodated when the visor is open (FIG. 17). When the visor 132 is closed it abuts to the front edge of the helmet shell 36 with its upper edge, and the lateral edges of the visor 132 abut to the outer surface of the helmet shell. Therefore the possibility that, in the use of the helmet, for example in forestry work, branches might get caught on the support arms 132*a*, 132*b* or the visor 132 itself and imperil the wearer of the helmet is neither given when the visor is closed nor when it is open.

In the following, the tightening unit 48 will be described in more detail. Alongside the ear protection 34, the tightening unit 48 is a further helmet accessory which, like the ear protection 34, is always located within the perimeter of the helmet shell 36 so that, in the area of the tightening unit 48 as well, no protruding parts exist on which obstacles might get caught. The tightening unit 48 will be described with reference to the drawings, particularly to FIGS. 12-16. FIG. 12 shows a side view of the interior fitting subassembly 40 of the protective helmet 30 in which the two ends of the neck band 46 are releasably connected by the tightening unit 48 in the neck area. FIG. 13 shows the interior fitting subassembly according to FIG. 12 mounted in the helmet shell 36 in a side view of the protective helmet 30, the tightening unit 48 being shown in the tightened state like in FIG. 12. FIG. 14 shows the protective helmet according to FIG. 13 in a view from below. FIG. 15 shows a cross sectional view of the protective helmet 30 when viewed in a backwards direction. FIG. 16 shows a partly broken representation of the protective helmet 30 according to FIG. 13 when viewed in the forward direction.

The tightening unit 48 comprises a mount 168 into which the free ends of the neck band 46 are inserted on both sides. The mount 168 is provided with angular knobs which can be brought in engagement with angular orifices 176 of the neck band 46. In this way the length of the neck band 46 can be crudely adjusted depending on the size of the head. The adjustment is appropriately carried out so that the protective helmet 30 can be conveniently put on when the tightening unit is not operated. The tightening of the neck band 46 will then be effected with the aid the tightening unit 48 after the helmet 30 was put on as explained below.

According to the representation in FIG. 14, the supporting shell 172 and the mount 168 are jointedly connected to each other by means of a transfer lever 169. According to FIG. 14, the transfer lever 169 is, at one end, connected to the, in FIG. 12, lower end of the supporting shell 172 by means of a joint 170. According to FIG. 16, the transfer lever 169 is connected to an, according to the representation, upper end of the mount 168 by means of a joint 171 at its other end.

The tightening unit 148 is operated by means of a latch flap 174 which is, according to FIG. 12, connected to the mount 168 by means of a joint 173. The latch flap 174 is provided with a tappet not shown in the drawings below the joint 173 on its side adjacent to the transfer lever 169. If the latch flap 174 is closed as shown in FIG. 12 the lower end of the mount 168 is pivoted backwards away from the joint 170 by the effect of the tappet on the transfer lever 169. Said pivoting causes a tightening of the neck band 46. In the process, the tightening unit 48 is supported by the supporting shell 172 in the neck area at the back of the head. A spring not illustrated in the drawings is allocated to the joint 171, said spring being positioned between the mount 168 and the transfer lever 169 so that the joint 170 of the transfer lever 169 is urged into the direction towards the lower end of the mount 168 when the latch flap 174 is opened. In the area of the joint 170 another spring (also not shown) is effective between the supporting shell 172 and the transfer lever 169 and aims at urging the supporting shell 172 into a position on a stopper in which its upper end is pivoted away from the upper end of the mount 168.

The operation of the tightening unit 48 is effected by means of the latch flap 174. If the latch flap 174 is pivoted clockwise and thus closed as shown in FIG. 12 the mount 168 is pivoted about the joint 171 so that the, according to the representation in FIG. 12, lower edge of the supporting shell 172 is spaced apart from the lower edge of the mount 168. This is the tightened position of the tightening unit which can be seen in FIGS. 12-14. If the latch flap 174 is pivoted counter-clockwise and thus opened the tightening unit 48 is opened. As a result the lower edge of the mount 168 can move in the direction toward the joint 170 on the supporting shell 172 so that the neck band 46 is released and the protective helmet 30 can be put on or taken off. If the protective helmet 30 has been put on only the latch flap 174 has to be pivoted downwards to fix the helmet 30 on the head. This can be conveniently done with one hand and also with a glove. On the front side the supporting shell 172 is covered by a piece of padding material 180.

The invention claimed is:

1. A protective helmet comprising a helmet shell, the protective helmet comprising: interior fittings comprising a subassembly to contact a head of a wearer comprised of at least, a head band, a neck band, and a plurality of support strips forming a supporting cage, and comprising means for fixing the subassembly to the helmet shell, the fixing means comprising at least three rigid supporting arms formed as spacers, wherein the supporting arms are formed on the supporting cage and protrude from the supporting cage obliquely downward in temple regions and backward in a back region of the head of the wearer, respectively, and wherein the helmet shell is dimensioned so and the supporting arms are dimensioned and arranged so that a clearance extending continuously around the subassembly interior fittings exists between the subassembly and the helmet shell for accommodating helmet accessories comprising at least hearing protection capsules along with supporting brackets and a mounting device thereof as well as mounting devices for further helmet accessories comprising at least a face protection, and wherein the hearing protection capsules are pivotable to a position in the clearance within the helmet shell.

2. The protective helmet according to claim 1, wherein the supporting cage is formed of a stiff, elastically flexible material.

3. The protective helmet of according to claim 1, wherein the mounting device for the hearing protection capsules comprises two ear protection supporting points on an inside of the helmet shell in which the supporting brackets comprising the hearing protection capsules are pivotably supported.

4. The protective helmet according to claim 3, wherein the ear protection supporting points and the supporting brackets are arranged and formed so that the supporting brackets are respectively pivotable between two positions within the clearance, an operating position in which the hearing protection capsules are arranged to cover ears of the wearer, and a parking position in which the hearing protection capsules are accommodated in the clearance.

5. The protective helmet according to claim 1, wherein the mounting device for the face protection comprises two face protection supporting points on an inside of the helmet shell in which two support arms of a visor are pivotably supported.

6. The protective helmet according to claim 5, wherein the face protection supporting points and the support arms of the visor are arranged and formed so that the support arms of the visor are respectively pivotable between two positions within the clearance, an operating position in which the visor is arranged to protect a face of the wearer, and a parking position in which the visor is located on an outer surface of the helmet shell in a close-fitting manner.

7. The protective helmet of according to claim 1, wherein the supporting cage comprises a peripherally closed support strip at its lower edge on which the supporting arms are integrally formed.

8. The protective helmet according to claim 7, wherein the neck band is attached to the supporting cage and has two ends which are releasably connected in a neck area of the wearer by means of a tightening unit accommodated in the clearance as a further helmet accessory.

9. The protective helmet according to claim 8, wherein the tightening unit comprises a supporting shell which is tightenable against a rear of the head of the wearer of the helmet when tightening the neck band with aid of a latch flap.

10. The protective helmet according to claim 1, wherein each of the supporting arms protruding downwards in the two temple regions comprise means for a releasable fixation on an inside of the helmet shell.

11. The protective helmet according to claim 10, wherein the fixation means on each of the supporting arms protruding downwards is formed to allow being brought in a positive engagement with the helmet shell.

12. The protective helmet according to claim 1, wherein the supporting arm protruding backwards in the region of the back of the head of the wearer comprises a locking device for the fixing to the helmet shell.

13. The protective helmet according to claim 5, wherein the face protection supporting points are formed as connectors fitted onto rod-like protrusions above the supporting arms in the temple regions.

14. The protective helmet according to claim 13, wherein through-holes respectively encompass the rod-like protrusions on a length which is at least equal to an inner width of the through-holes so that a force applied to the supporting arms in the temple regions from above due to by a load acting on the helmet generates a momentum at the supporting arms in the temple regions which strives to deform the helmet shell inwardly as far as to a lower edge.

15. The protective helmet according to claim 1, wherein the supporting cage comprises two support arms protruding downwards to which the neck band is respectively fixable at a selectable height.

16. The protective helmet according to claim 15, wherein the supporting arms and the support arms are further stiffened by integrally formed ribs.

* * * * *